US008725038B2

(12) United States Patent
Yamaguchi et al.

(10) Patent No.: US 8,725,038 B2
(45) Date of Patent: May 13, 2014

(54) BELT ASSEMBLY, FIXING DEVICE, AND IMAGE FORMING APPARATUS INCORPORATING SAME

(75) Inventors: Yoshiki Yamaguchi, Kanagawa (JP); Masaaki Yoshikawa, Tokyo (JP); Kenji Ishii, Kanagawa (JP); Yuji Arai, Kanagawa (JP); Hiromasa Takagi, Tokyo (JP); Naoki Iwaya, Tokyo (JP); Tetsuo Tokuda, Kanagawa (JP); Yutaka Ikebuchi, Kanagawa (JP); Takuya Seshita, Kanagawa (JP); Takahiro Imada, Kanagawa (JP); Ippei Fujimoto, Kanagawa (JP); Hiroshi Yoshinaga, Chiba (JP); Hajime Gotoh, Kanagawa (JP); Arinobu Yoshiura, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 13/311,002

(22) Filed: Dec. 5, 2011

(65) Prior Publication Data

US 2012/0148303 A1 Jun. 14, 2012

(30) Foreign Application Priority Data

Dec. 14, 2010 (JP) ..... 2010-278139

(51) Int. Cl.
*G03G 15/20* (2006.01)

(52) U.S. Cl.
USPC ..... 399/122; 399/329

(58) Field of Classification Search
USPC ..... 399/122, 328, 329
See application file for complete search history.

(56) References Cited

U.S. PATENT DOCUMENTS 7,107,000 B2 * 9/2006 Watanabe et al. ..... 399/328
7,242,895 B2 * 7/2007 Inada et al. ..... 399/328
7,272,353 B2 * 9/2007 Blair et al. ..... 399/329

(Continued)

FOREIGN PATENT DOCUMENTS

CN 1453666 A 11/2003
CN 1648785 A 8/2005

(Continued)

OTHER PUBLICATIONS

Office Action issued on Dec. 26, 2013, in counterpart Chinese Appln No. 201110407953.6 (6 pages).

*Primary Examiner* — David Gray
*Assistant Examiner* — Carla Therrien
(74) *Attorney, Agent, or Firm* — Oblon, Spivak, McClelland, Maier & Neustadt, L.L.P.

(57) ABSTRACT

A fixing device includes a frame, a tubular belt holder, a rotatable, flexible fuser belt, a heater, a fuser pad, a pressure member, and a mounting attachment. The tubular belt holder extends in an axial direction thereof. The fuser belt is looped into a generally cylindrical configuration around the belt holder to rotate in a circumferential direction of the belt holder. The heater is disposed adjacent to the belt holder to heat the belt holder. The fuser pad is accommodated in the belt holder inside the loop of the fuser belt, and extends in the axial direction. The pressure member is disposed opposite the belt holder with the fuser belt interposed between the fuser pad and the pressure member. The mounting attachment is provided to a longitudinal end of the tubular belt holder to allow retention and detachable attachment of the belt holder end to the frame.

18 Claims, 14 Drawing Sheets

(56) References Cited

U.S. PATENT DOCUMENTS

| | | | | |
|---|---|---|---|---|
| 7,283,780 | B2 | 10/2007 | Uchida et al. | |
| 7,885,569 | B2 | 2/2011 | Kishi et al. | |
| 7,957,663 | B2 | 6/2011 | Kishi et al. | |
| 8,160,484 | B2 * | 4/2012 | Hasegawa et al. | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |
| 2012/0051774 | A1 * | 3/2012 | Ikebuchi et al. | 399/67 |
| 2012/0114345 | A1 * | 5/2012 | Fujimoto et al. | 399/44 |
| 2012/0121304 | A1 * | 5/2012 | Tokuda et al. | 399/329 |
| 2012/0121305 | A1 * | 5/2012 | Yoshikawa et al. | 399/329 |
| 2012/0155936 | A1 * | 6/2012 | Yamaguchi et al. | 399/329 |

FOREIGN PATENT DOCUMENTS

| | | | |
|---|---|---|---|
| CN | 1725119 | A | 1/2006 |
| CN | 101017344 | A | 8/2007 |
| JP | 2010-96782 | | 4/2010 |

* cited by examiner

BELT ASSEMBLY, FIXING DEVICE, AND IMAGE FORMING APPARATUS INCORPORATING SAME

CROSS-REFERENCE TO RELATED APPLICATIONS

This patent application claims priority pursuant to 35 U.S.C. §119 to Japanese Patent Applications No. 2010-278139, filed on Dec. 14, 2010, the entire disclosure of which is hereby incorporated by reference herein.

BACKGROUND

1. Technical Field

The present invention relates to a belt assembly, a fixing device, and an image forming apparatus incorporating the same, and more particularly, to a belt assembly for use in a fixing device that fixes a toner image in place on a recording medium with heat and pressure, and an electrophotographic image forming apparatus, such as a photocopier, facsimile machine, printer, plotter, or multifunctional machine incorporating several of those imaging functions, which employs such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

FIG. 1 is a schematic view of one example of fixing device 220.

As shown in FIG. 1, the fixing device 220 includes a multi-roller, belt-based fuser assembly that employs an endless, flexible fuser belt 204 entrained around multiple support rollers 202 and 203, paired with a pressure roller 205 that presses against the outer surface of the fuser belt 204 to form a fixing nip N therebetween. One of the belt support rollers is equipped with an internal heater 201, which heats the length of the fuser belt 204 through contact with the internally heated roller 202. As the rotary fixing members 204 and 205 rotate together, a recording sheet S is conveyed through the fixing nip N, at which a toner image on the incoming sheet S is fixed in place with heat from the fuser belt 204 and pressure from the pressure roller 205.

Although advantaged over a configuration that employs a conventional fuser roller instead of a fuser belt, the fixing device 220 described above involves a substantial warm-up time to heat the fixing nip to a temperature sufficient for fusing toner and first-print time to complete an initial print job upon activation. Prolonged warm-up time and first-print time required with the multi-roller belt fuser assembly limits application of the fixing device 220 to relatively slow imaging systems.

FIG. 2 is a schematic view of another example of fixing device 320.

As shown in FIG. 2, the fixing device 320 includes a film-based fuser assembly that employs a fuser belt 304 formed of thin heat-resistant film cylindrically looped around a stationary, ceramic heater 301, which is paired with a pressure roller 305 that presses against the stationary heater 301 through the fuser belt 304 to form a fixing nip N therebetween. As the pressure roller 305 rotates to in turn rotate the fuser belt 304, a recording sheet S is advanced into the fixing nip N, at which the stationary heater 301 heats the incoming sheet S via the fuser belt 304, so that a toner image is fixed in place with heat from the stationary heater 301 and pressure from the pressure roller 305.

Compared to the belt-based fuser assembly, the film-based fuser assembly is superior in terms of processing speed and thermal efficiency. Owing to the thin heat-resistant film which exhibits a relatively low heat capacity, the film-based fuser assembly can be swiftly heated, and therefore eliminates the need for keeping the heater in a sufficiently heated state when idle, resulting in a shorter warm-up time and smaller amounts of energy wasted during standby, as well as a relatively compact size of the fixing device. The film-based fixing device, thus overcoming the limitation of the belt-based fixing device, finds applications in high-speed, on-demand compact printers that can promptly execute a print job upon startup with significantly low energy consumption.

Although generally successful for its intended purpose, the fixing device employing a film-based fuser assembly also has drawbacks. One drawback is its vulnerability to wear, where the heat-resistant film has is repeatedly brought into frictional contact with the stationary ceramic heater. The frictionally contacting surfaces of the film and the heater readily chafe and abrade each other, which, after a long period of operation, results in increased frictional resistance at the heater/film interface, leading to disturbed rotation of the fuser belt, or increased torque required to drive the pressure roller. If not corrected, such defects can eventually cause failures, such as displacement of a printed image caused by a recording sheet slipping through the fixing nip, and damage to a gear train driving the rotary fixing members due to increased stress during rotation.

Another drawback is the difficulty in maintaining a uniform processing temperature throughout the fixing nip. The problem arises where the fuser film, which is once locally heated at the fixing nip by the heater, gradually loses heat as it travels downstream from the fixing nip, so as to cause a discrepancy in temperature between immediately downstream from the fixing nip (where the fuser belt is hottest) and immediately upstream from the fixing nip (where the fuser belt is coldest). Such thermal instability adversely affects fusing performance of the fixing device, particularly in high-speed applications where the rotational fixing member tends to dissipate higher amounts of heat during rotation at a high processing speed.

Vulnerability to wear of a film-based fuser assembly has been addressed by another, improved fixing device that uses a lubricant, such as a low-friction sheet of fiberglass impregnated with polytetrafluoroethylene (PTFE), to lubricate between adjoining surfaces of a stationary pressure pad and a rotatable fixing belt. In this fixing device, the fixing belt is looped for rotation around the stationary pressure pad, while held in contact with an internally heated, rotatable fuser roller that has an elastically deformable outer surface 28*dhe* pressure pad is spring-loaded to press against the fuser roller through the fixing belt, which establishes a relatively large fixing nip therebetween as the fuser roller elastically deforms under pressure.

According to this arrangement, provision of the lubricant sheet prevents abrasion and chafing at the interface of the stationary and rotatable fixing members, as well as concomitant defects and failures of the fixing device. Moreover, the relatively large fixing nip translates into increased efficiency in heating a recording sheet by conduction from the fuser roller, which allows for designing a compact fixing device with reduced energy consumption.

However, even this improved method does not address the thermal instability caused by locally heating the fixing belt at the fixing nip. Further, this method involves a fixing roller that exhibits a higher heat capacity than that of a fixing belt or film, and therefore requires more time to heat the fixing member to a desired processing temperature during warm-up than would be otherwise required. Hence, although designed to provide an increased thermal efficiency through use of an elastically deformable fuser roller, the method fail to provide satisfactory fixing performance for high-speed, on-demand applications.

To cope with the problems of the fixing device using a cylindrically looped, rotatable fixing belt, several methods have been proposed.

For example, one such method proposes a fuser assembly that employs a stationary, thermal belt holder or heat pipe including a thin-walled, hollow cylindrical tubular body of thermally conductive material or metal. A fuser belt is entrained around the belt holder while heated by a resistive heater such as a ceramic heater disposed in the hollow interior of the belt holder. A coating of lubricant may be deposited on an outer circumferential surface of the belt holder to allow smooth movement of the belt sliding against the belt holder.

According to this method, the thermal belt holder can swiftly conduct heat to the fuser belt, while guiding substantially the entire length of the belt along the outer circumference thereof. Compared to a stationary heater or heated roller that locally heats the fuser belt or film solely at the fixing nip, using the thermally conductive belt holder allows for heating the fuser belt swiftly and uniformly, resulting in shorter warm-up times which meet high-speed, on-demand applications.

In a sophisticated arrangement, the belt holder may be used in conjunction with a contact, fuser pad accommodated in the belt holder inside the loop of the fuser belt to support pressure from the pressure member to establish a fixing nip, as well as a reinforcing member that supports the fuser pad under pressure from the pressure member. Provision of the fuser pad and the reinforcing member allows for stable operation of the fixing device without variations in shape, dimensions, and/or strength of the fixing nip, which would occur where the belt holder itself were subjected to nip pressure, causing deformation and displacement of the thin-walled tubular body.

To mount such a belt holder in proper operational position, a mounting flange may be employed in the fixing device. The mounting flange for a belt holder typically includes a combination of flanged and tubular portions, the former for affixation to a frame of the fixing device, and the latter for insertion into a longitudinal end of the tubular belt holder, thereby positioning and retaining the belt holder in its generally cylindrical configuration. For precise positioning and retention of the belt holder, such a mounting flange is dimensioned to fit the belt holder with an extremely small space or clearance of 0.15 mm or smaller left between adjoining circumferential surfaces of the tubular inserted portion and the belt holder.

BRIEF SUMMARY

Exemplary aspects of the present invention are put forward in view of the above-described circumstances, and provide a novel fixing device.

In one exemplary embodiment, the fixing device includes a frame, a tubular belt holder, a rotatable, flexible fuser belt, a heater, a fuser pad, a pressure member, and a mounting attachment. The frame defines a space in which the fixing device is accommodated. The tubular belt holder extends in an axial direction thereof. The fuser belt is looped into a generally cylindrical configuration around the belt holder to rotate in a circumferential direction of the belt holder. The heater is disposed adjacent to the belt holder to heat the belt holder to in turn heat the fuser belt through conduction. The fuser pad is accommodated in the belt holder inside the loop of the fuser belt, and extends in the axial direction of the belt holder. The pressure member is disposed opposite the belt holder with the fuser belt interposed between the fuser pad and the pressure member. The pressure member presses in a load direction against the fuser pad through the fuser belt to form a fixing nip therebetween, through which a recording medium travels in a conveyance direction under heat and pressure. The mounting attachment is provided to a longitudinal end of the tubular belt holder to allow retention and detachable attachment of the belt holder end to the frame. The attachment includes a flange and a tubular insert. The flange is adapted to be affixed to the frame. The tubular insert extends from the flange to be inserted into the longitudinal end of the belt holder. The tubular insert has a free axial end thereof at least partially protruding and tapered to form a tapered guide surface, along which an inner circumferential surface of the belt holder is slidably guided onto an outer circumferential surface of the tubular insert being inserted into the longitudinal end of the belt holder.

Other exemplary aspects of the present invention are put forward in view of the above-described circumstances, and provide an image forming apparatus incorporating a fixing device.

Still other exemplary aspects of the present invention are put forward in view of the above-described circumstances, and provide a belt assembly.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
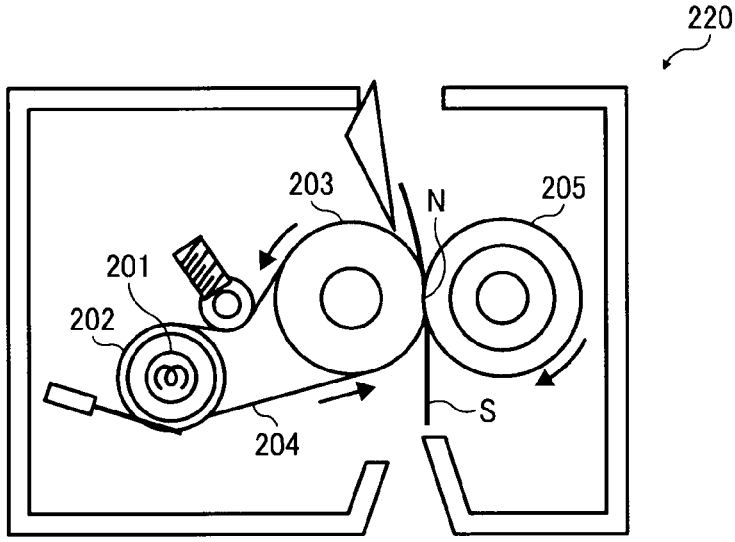
FIG. 1 BACKGROUND ART
FIG. 1 is a schematic view of one example of fixing device.
Figure 2:
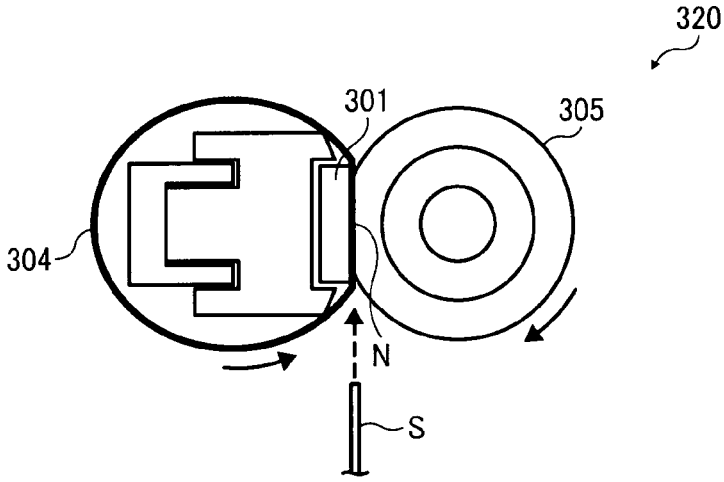
FIG. 2 BACKGROUND ART
FIG. 2 is a schematic view of another example of fixing device.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 3:
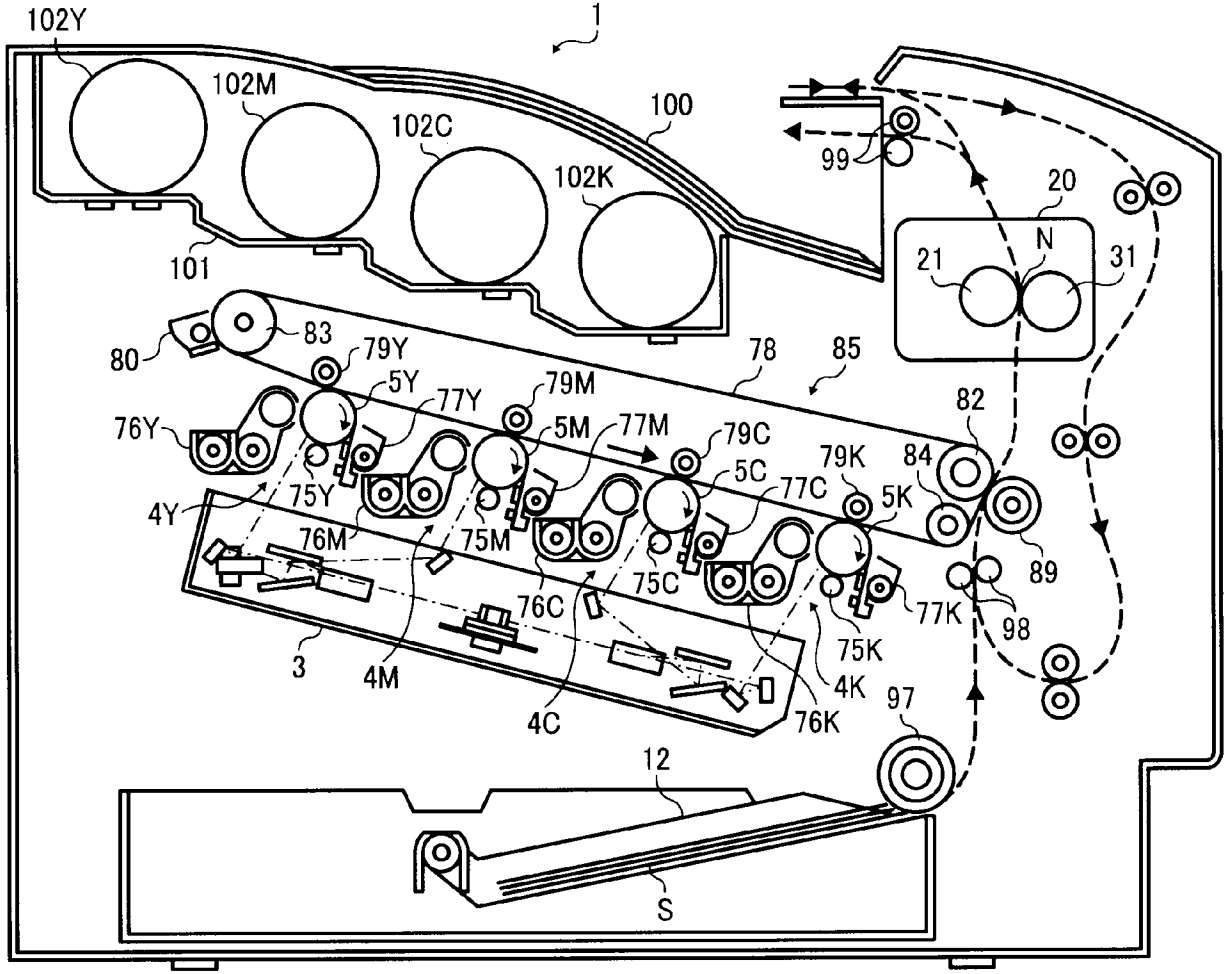
FIG. 3 schematically illustrates an image forming apparatus incorporating a fixing device according to one embodiment of this patent specification.

FIG. 3 schematically illustrates an image forming apparatus 1 incorporating a fixing device 20 according to one embodiment of this patent specification.

As shown in FIG. 3, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 4 and subsequent drawings.

During operation, each imaging unit 4 rotates the photoconductor drum 5 clockwise in the drawing to forward its outer, photoconductive surface 28*do* a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface 28*do* form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 is supplied with a bias voltage of a polarity opposite that of the toner on the photoconductor drum 5. This electrostatically transfers the toner image from the photoconductive surface 28*do* an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 4:
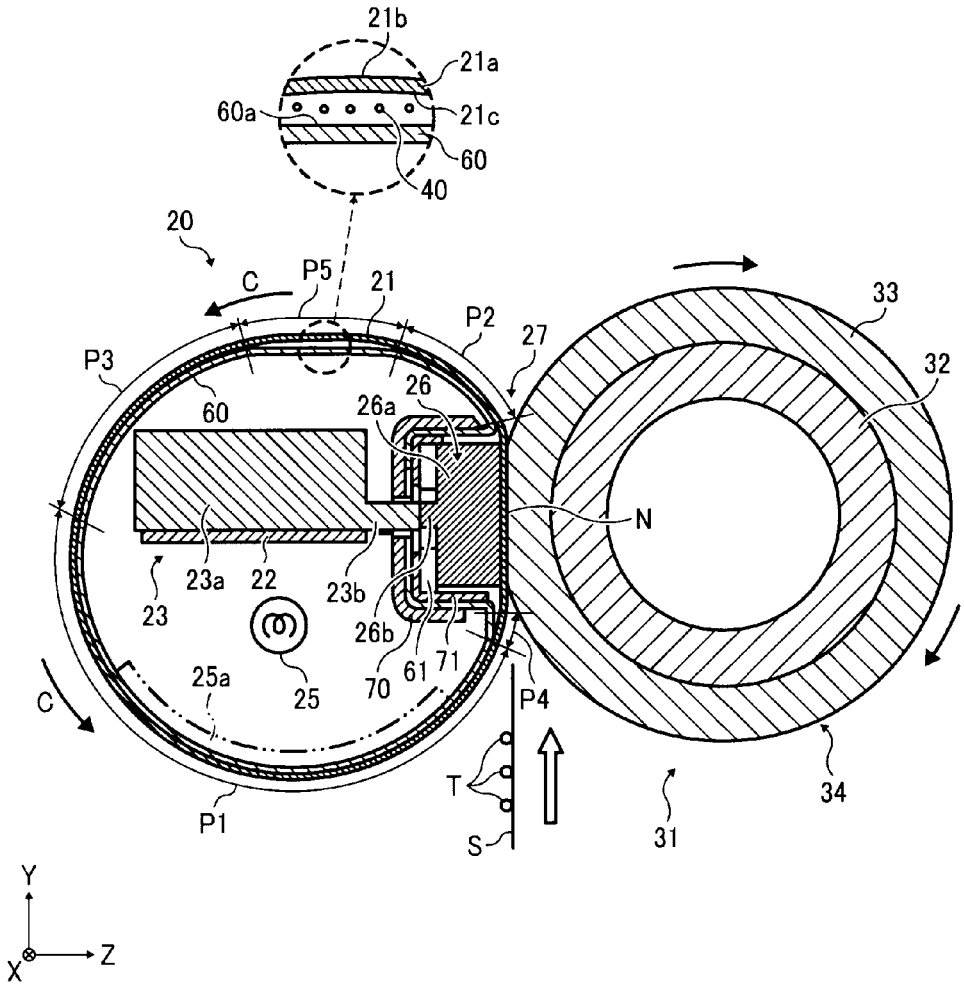
FIG. 4 is an end-on, axial cutaway view of the fixing device incorporated in the image forming apparatus of FIG. 3.

FIG. 4 is an end-on, axial cutaway view of the fixing device 20 incorporated in the image forming apparatus 1 according to one embodiment of this patent specification.

As shown in FIG. 4, the fixing device 20 includes a generally cylindrical, tubular belt holder 60 extending in an axial direction X thereof; a rotatable, flexible fuser belt 21 looped into a generally cylindrical configuration around the belt holder 60 to rotate in a circumferential direction C of the belt holder 60; a heater 25 disposed adjacent to the belt holder 60 to heat the belt holder 60 to in turn heat the fuser belt 21 through conduction; an elongated fuser pad 26 accommodated in the belt holder 60 inside the loop of the fuser belt 21, having a longitudinal central axis thereof extending in the axial direction X of the belt holder 60; and a pressure roller 31 disposed opposite the belt holder 60 with the fuser belt 21 interposed between the fuser pad 26 and the pressure roller 31. The pressure roller 31 presses in a load direction Y against the fuser pad 26 through the fuser belt 21 to form a fixing nip N therebetween, through which a recording sheet S travels in a conveyance direction Z under heat and pressure as the rotatable fixing members 21 and 31 rotate together. Inside the belt holder 60 is a stationary, reinforcing member 23 that reinforces the fuser pad 26 where the pressure roller 31 presses against the fuser pad 26.

Figure 5:
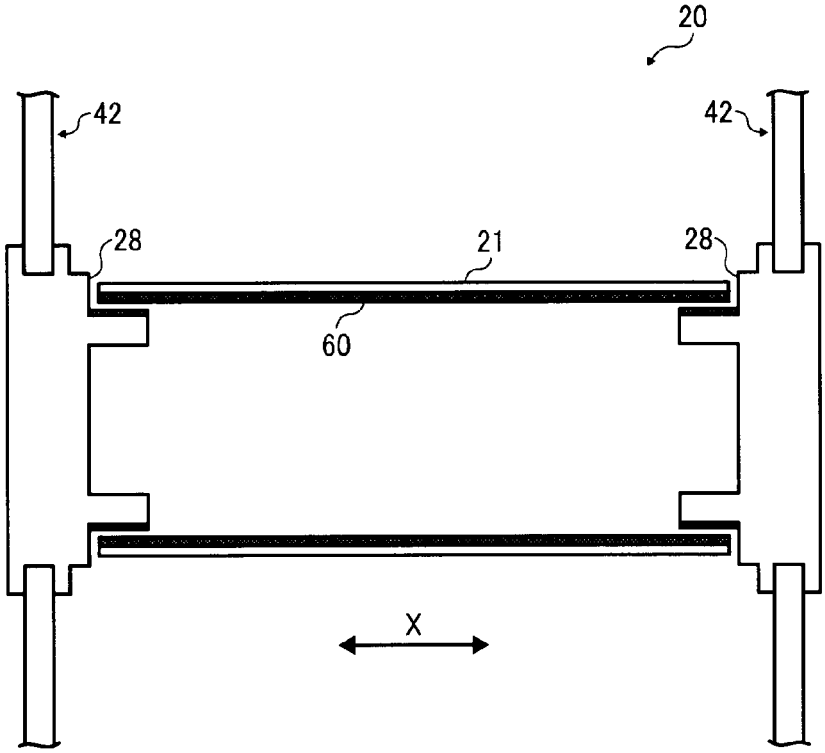
FIG. 5 is an axial cross-sectional view of a fuser belt assembly mounted in the fixing device of FIG. 4.

With additional reference to FIG. 5, which is an axial cross-sectional view of the fuser assembly mounted in the fixing device 20, the belt holder 60 is shown having its opposed longitudinal ends supported on a pair of sidewalls 42 of the fixing device 20 via a pair of mounting attachments 28 that holds the fuser belt 21 in position in the axial direction X. The mounting attachments 28 are shaped and dimensioned to engage with the fuser pad 26, the reinforcing member 23, and the heater 25 inside the loop of the fuser belt 21, so as to secure those internal components to the belt holder 60.

Figure 6:
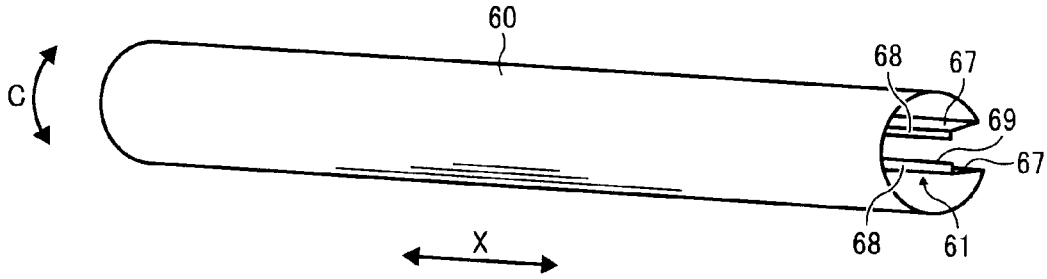
FIG. 6 is a perspective view of a tubular belt holder before assembly, included in the fixing device of FIG. 4.

With still additional reference to FIG. 6, which is a perspective view of the belt holder 60 before assembly, the generally cylindrical, tubular body of the belt holder 60 is shown extending in the axial, longitudinal direction X and curved or rolled in the circumferential direction C.

As used herein, the term "axial direction X" refers to a direction parallel to a longitudinal, rotational axis of the tubular belt holder 60 around which rotates a generally cylindrical body, in particular, the fuser belt 21. The term "circumferential direction C" refers to a direction along a circumference of a generally cylindrical body, in particular, that of the fuser belt 21 or the belt holder 60. Also, the term "conveyance direction Y" refers to a direction perpendicular to the axial direction X, in which a recording medium is conveyed along the fixing nip N. The term "load direction Z" refers to a direction perpendicular to the axial direction X and the conveyance direction Y, in which the pressure member presses against the fuser pad to establish the fixing nip N. These directional terms apply not only to the fuser belt 21 and the belt holder 60 themselves but also to their associated structures, in particular, the mounting attachments 28 provided to the longitudinal ends of the belt holder 60, either in their operational position after assembly or in their unassembled, original forms before or during assembly.

During operation, upon initiation of image formation processes in response to a print request input by a user manipulating an operating panel or transmitted via a computer network, a rotary drive motor activates the pressure roller 31 to rotate clockwise in the drawing, which in turn rotates the fuser belt 21 counterclockwise in the drawing around the belt holder 60. The pressure roller 31 is equipped with a biasing mechanism that presses the pressure roller 31 in the load direction Z against the fuser pad 26 via the fuser belt 21 to form a fixing nip N therebetween.

Meanwhile, the power source starts supplying electricity to the heater 22, which then generates heat for conduction to the belt holder 60 to in turn heat the fuser belt 21 rotating therearound. Initiation of the heater power supply may be simultaneous with activation of the rotary drive motor. Alternatively, the two events precede or follow each other with an appropriate interval of time depending on specific configuration. Power supply to the heater 22 is adjusted according to readings of a thermometer disposed at a suitable location adjacent to the fuser belt 21, for example, along the inner circumferential surface of the belt holder 60 subjected to heating, so as to heat the fixing nip N to a given processing temperature sufficient for processing toner particles in use.

With the fixing nip N thus established, a recording sheet S bearing an unfixed, powder toner image T enters the fixing device 20 with its front, printed face brought into contact with the fuser belt 21 and bottom face with the pressure roller 31. As the fuser belt 21 and the pressure roller 31 rotate together, the recording sheet S moves in the conveyance direction Y through the fixing nip N, where the fuser belt 21 heats the incoming sheet S to fuse and melt the toner particles, while the pressure roller 31 presses the sheet S against the fuser pad 26 to cause the molten toner to settle onto the sheet surface.

Specifically, the fuser belt 21 comprises a flexible, endless belt of multilayered structure, consisting of a thermally conductive substrate 21*a* having one surface covered with an outer layer of release agent 21*b*, and another, opposite surface provided with an inner coating layer 21*c*, looped into a generally cylindrical configuration, approximately 15 mm to approximately 120 mm in diameter, so that the outer layer 21*b* faces the exterior of the loop and the inner layer 21*c* faces the interior of the loop. In the present embodiment, the fuser belt 21 is a multilayered endless belt having an outer diameter of approximately 30 mm in its looped, generally cylindrical configuration before assembly with the belt holder 60.

The belt substrate 21*a* may be formed of any thermally conductive material, approximately 30 μm to approximately 50 μm thick, which conducts sufficient heat for fusing toner on the recording medium. Examples of such material include, but are not limited to, iron, cobalt, nickel, or an alloy of such metals, as well as synthetic resin such as polyimide (PI).

The release layer 21*b* may be formed of any releasing agent deposited approximately 10 μm to approximately 50 μm thick on the substrate 21*a* for providing good release of toner where the fuser belt 21 comes into contact with the toner image T. Examples of such release agent include, but are not limited to, fluorine compound such as tetra fluoro ethylene-perfluoro alkylvinyl ether copolymer or perfluoroalkoxy (PFA), polytetrafluoroethylene (PTFE), polyimide (PI), polyetherimide (PEI), polyethersuffide (PES), or the like.

The coating layer 21*c* may be formed of any lubricant deposited on the substrate 21*a* for reducing friction between the fuser belt 21 and the belt holder 60. Examples of such lubricant include, but are not limited to, a low-frictional, anti-abrasive coating of PTFE, commercially available under the trademark Teflon®, metal plating, diamond-like carbon (DLC) coating, and glass coating.

The belt holder 60 comprises a longitudinally slotted tubular body having a generally circular, C-shaped cross-section, such as a thin-walled pipe of press-formed metal approximately 0.1 mm to approximately 1 mm thick, having a longitudinal side slot 61 in one side thereof for accommodating the fuser pad 26 therein, while retaining the fuser belt 21 therearound as the belt 21 rotates in the circumferential direction C of the belt holder 60.

The belt holder 60 has its outer, circumferential surface provided with a coating layer 60*a*. The coating layer 60*a* may be formed of any lubricant deposited on the tubular body for reducing friction between the fuser belt 21 and the belt holder 60. Examples of such lubricant include, but are not limited to, a low-frictional, anti-abrasive coating of PTFE, commercially available under the trademark Teflon®, metal plating, DLC coating, and glass coating. A lubricating agent 40, such as grease, may be deposited between the outer circumferential surface of the belt holder 60 and the inner circumferential surface of the fuser belt 21, so as to provide additional lubrication between the adjoining surfaces of the fuser belt 21 and the belt holder 60.

Figure 7:
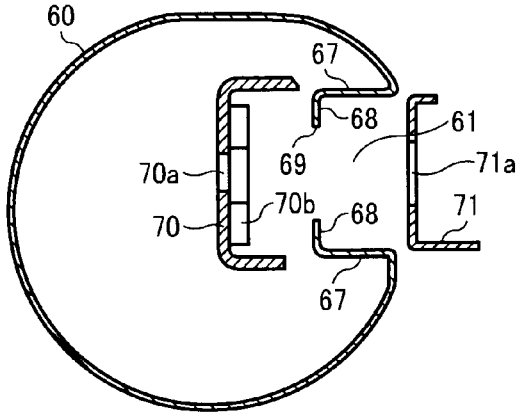
FIG. 7 is a cross-sectional view of the belt holder during assembly.
Figure 8:
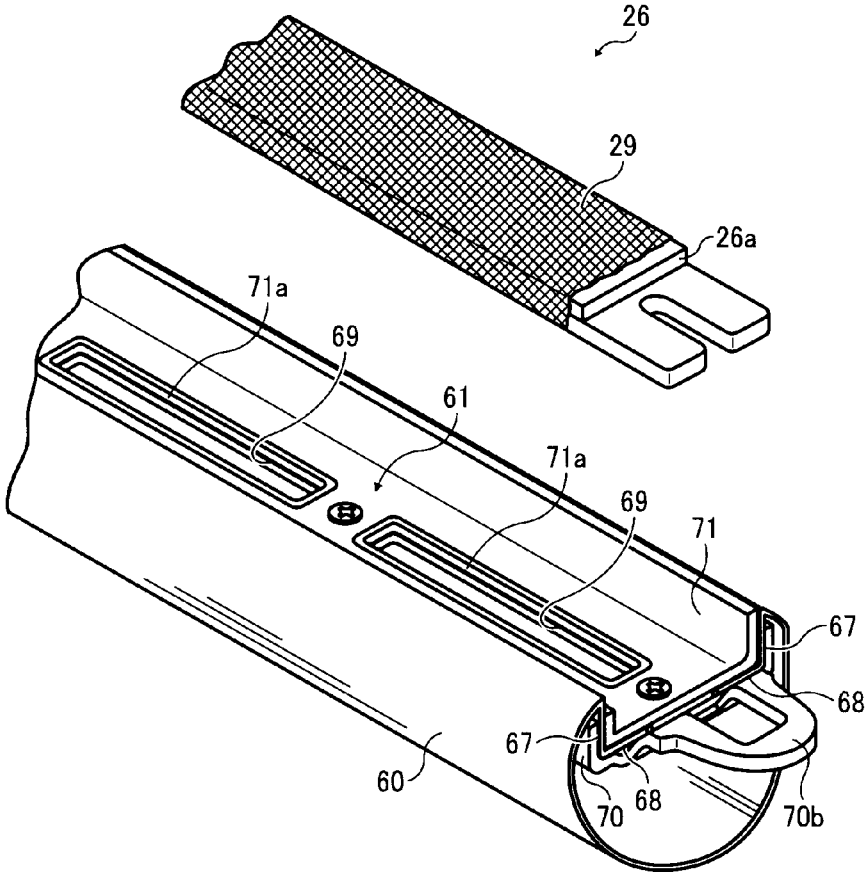
FIG. 8 is a perspective view of the belt holder during assembly.

With additional reference to FIGS. 7 and 8, which are cross-sectional and perspective views, respectively, of the belt holder 60 during assembly, the belt holder 60 is shown having its side slot 61 consisting of a pair of opposed parallel sidewalls 67 extending inward and bent toward each other to form a central, interior wall 68 therebetween with a longitudinal opening or slit 69 defined in the interior wall 68 to allow access from inside to outside the tubular body.

The belt holder 60 is provided with a pair of inner and outer, retaining stays 70 and 71 around the side slot 61, each being an elongated piece having a rectangular U-shaped cross-section, the former fitted along the inner surfaces of the holder 60 and the latter along the outer surfaces of the holder 60. The retaining stays 70 and 71 are screwed onto each other while clamping together the adjoining walls 67 and 68 therebetween, so as to retain the belt holder 60 in the proper, generally cylindrical configuration with its side slot 61 in shape.

The retaining stays 70 and 71 define longitudinal openings 70*a* and 71*a*, respectively, in their central walls facing the interior wall 68 of the side slot 61, each of which is aligned with the slit 69 of the side slot 68 to together define a through-hole which allows the reinforcing member 23 to extend outward from inside the belt holder 60 to contact the fuser pad 26 in the side slot 61. Also, the inner retaining stay 70 has its longitudinal ends provided with a pair of flanges 70*b* (of which only one is shown in FIG. 8), each adapted for connection with the mounting attachment 28 to secure the stay 70 to the belt holder 60.

The fuser pad 26 comprises an elongated, substantially rectangular piece of heat-resistant elastic material, such as liquid crystal polymer (LCP), PI, polyamide-imide (PAD, dimensioned to be received within the outer stay 71 of the holder side slot 61, extending in the axial direction X of the belt holder 60.

Figure 9:
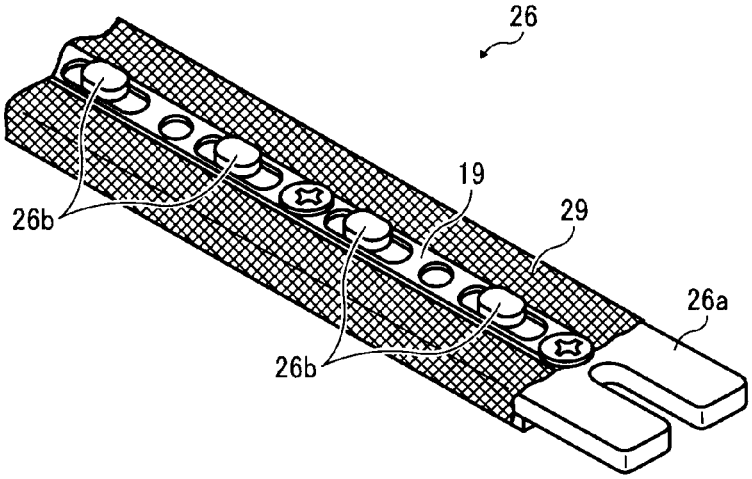
FIG. 9 is a perspective view of a fuser pad before assembly, included in the fixing device of FIG. 4.

With additional reference to FIG. 9, which is a perspective view of the fuser pad 26 before assembly, the fuser pad 26 is shown including an elongated body 26*a* that defines a smooth surface on a front side of the fuser pad 26, and multiple contact portions or protrusions 26*b* arranged in series along the length of the elongated body 26*a* on a rear side opposite the front side of the fuser pad 26. A covering 29 of anti-friction material, such as a web of PTFE fibers, is wrapped around the elongated body 26*a* for reducing friction between the fuser pad 26 and the fuser belt 21, with a perforated attachment 19 fitted around the protrusions 26*b* and screwed onto the elongated body 26*a* to secure the covering 29 in position.

The fuser pad 26 is inserted into the side slot 61 of the belt holder 60 with the front, smooth surface of the elongated body 26*a* facing outward and the multiple protrusions 26*b* facing inward of the tubular holder 60, so that the smooth surface of the body 26*a* slidably contacts the pressure roller 31 via the fuser belt 21 and the protrusions 26*b* contact the reinforcing member 23 through the openings 69, 70*a*, and 71*a* aligned with each other. The fuser pad 26 is secured in position on the belt holder 60 via the mounting attachments 28.

In such a configuration, the fuser pad 26 can support nip pressure from the pressure roller 31 without significant deformation and displacement during operation, where the elongated body 26*a* slightly bends under pressure applied in the load direction Y to cause the protrusions 26*b* to contact the reinforcing member 23 to relieve nip pressure therethrough. Although the fuser pad 26 in the present embodiment is configured with the elongated body 26*a* defining a substantially planar, smooth surface to face the pressure roller 31, alternatively, instead, the smooth surface of the elongated body 26*a* may be formed in a concave configuration that can conform to the curved circumferential surface of the pressure roller 31 where the fuser pad 26 is subjected to nip pressure.

The reinforcing member 23 comprises an elongated, substantially rectangular piece of metal, dimensioned to be accommodated inside the tubular body of the belt holder 60, extending in the axial direction X of the belt holder 60.

Figure 10:
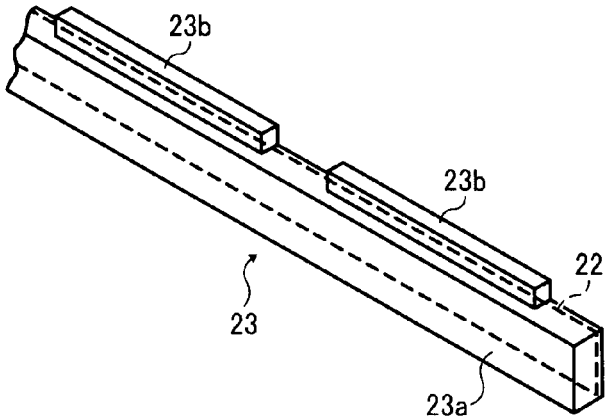
FIG. 10 is a perspective view of a reinforcing member before assembly, included in the fixing device of FIG. 4.

With additional reference to FIG. 10, which is a perspective view of the reinforcing member 23 before assembly, the reinforcing member 23 is shown consisting of a rigid, elongated beam 23*a*; multiple contact portions or protrusions 23*b* disposed along the length of the beam 23*a* on a side to face the fuser pad 26; and a reflector plate or cover 22 disposed where the beam 23*a* faces the heater 25 upon assembly inside the tubular belt holder 60.

The reinforcing member 23 is inserted into the belt holder 60 with the contact protrusions 23*b* extending outward through the aligned openings 70*a*, 69, and 71*a* to contact the contact protrusions 26*b* on the rear side of the fuser pad 26. The reinforcing member 23 is secured in position on the belt holder 60 via the mounting attachments 28.

In such a configuration, the reinforcing member 23 supports the fuser pad 26 under pressure from the pressure roller 31, wherein the rigid beam 23*a* receives nip pressure on the rear side of the fuser pad 26 transmitted through the contact portions 26*a* and 23*b* from the elongated body 26*a* of the fuser pad 26. The reflector cover 22 serves to reflect radiation from the heater 25 inside the belt holder 60, so as to prevent an undue amount of heat from being dissipated in the rigid beam 23*a*.

Provision of the openings 69, 70*a*, and 71*a* enables the contact protrusions 23*b* of the reinforcing member 23 to thrust against the corresponding protrusions 26*b* of the fuser pad 26 without contacting the adjoining walls of the belt holder 60 where the fuser pad 26 bends under nip pressure during operation. This arrangement isolates the belt holder 60 from direct contact with the reinforcing member 23, and thus from pressure applied to the fuser pad 26 from the pressure roller 31, which would otherwise deform the thin-walled belt holder 60 from its generally cylindrical shape, leading to concomitant failures during operation.

The heater 25 comprises an elongated, radiant heating wire extending inside the tubular belt holder 60 in the axial direction X to radiate heat to an inner circumferential surface of the belt holder 60. The inner circumferential surface of the belt holder 60 may be coated with a black, thermally absorptive material to increase emissivity of the belt holder 60 for obtaining high thermal efficiency in heating the fuser belt 21 with the radiant heater 25. A thermometer may be disposed adjacent to the heater 25 to detect an operational temperature of the fuser belt 21 during operation.

Although in the embodiment described in FIG. 4, the heater 25 is configured as a radiant heater, which is ready to assemble and allows for an uncomplicated configuration of the fixing device 20, alternatively, instead, it is possible to configure the heater 25 as any heating element that can heat the belt holder 60 through radiation, conduction, induction, or any possible combination thereof.

For example, the heater 25 may be a laminated, planar heating element 25*a* extending inside and in contact with the tubular belt holder 60 in the axial direction X to conduct heat to an inner circumferential surface of the belt holder 60, as indicated by broken lines 25*a* in FIG. 4.

Figure 11:
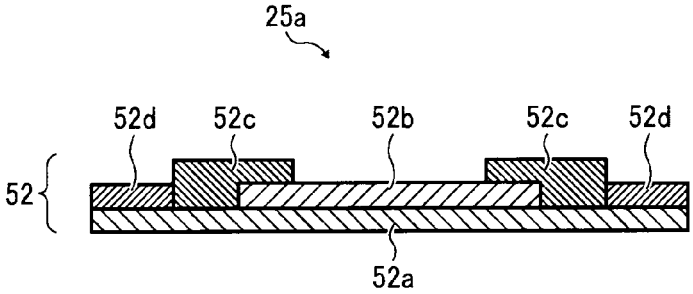
FIG. 11 is a cross-sectional view of a planar heating element for use in the fixing device of FIG. 4.

Specifically, with additional reference to FIG. 11, which is a cross-sectional view of an example of the planar resistive heater, the planar heating element 25*a* is shown including a laminated heat generator 52 formed of a resistive heating layer 52*b* of heat-resistant material with conductive particles dispersed therein, and an electrode layer 52*c* for supplying electricity to the resistive layer 52*b*, which are deposited adjacent to each other upon an electrically insulative substrate 52*a* to together form a heating circuit that generates heat for conduction to the heat pipe 22. An insulation layer 52*d* is disposed to separate the resistive layer 52*b* from adjacent electrode layers of other heating circuits while isolating edges of the generator 52 from external components. A set of electrode terminals may also be provided at opposed longitudinal ends of the generator 52 to conduct electricity from wiring to the heating circuitry.

Using such a planar heating element instead of a radiant heater allows direct transmission of heat to the circumferential surface of the belt holder 60 to effectively heat the belt holder 60, leading to energy-efficient, fast fixing process with reduced warm-up time and first-print time required to process a print job.

Alternatively, instead, the heater 25 may be an induction heater with an inductor coil disposed inside or outside the tubular belt holder 60 in the axial direction X to generate heat in inner circumferential surface of the belt holder 60 through electromagnetic induction.

Using such an induction heater instead of a radiant heater allows for effective and reliable heating of the belt holder 60, in which the induction heating can selectively heat only those intended portions of the fuser assembly, i.e., the belt holder 60, while leaving the surrounding structure, such as the reinforcing member 23, unheated.

The mounting attachment 28 comprises a flanged tubular piece of suitable material provided to a longitudinal end of the tubular belt holder 60 around which the fuser belt 21 is rotatably entrained, while retaining the longitudinal ends of the fuser pad 26, the inner retaining stay 70, the reinforcing member 23, and the heater 25 in their proper operational position, so as to form a single, integrated unit detachably attachable to the frame or sidewalls 42 of the fixing device 20 during mounting into the image forming apparatus 1.

Figure 12:
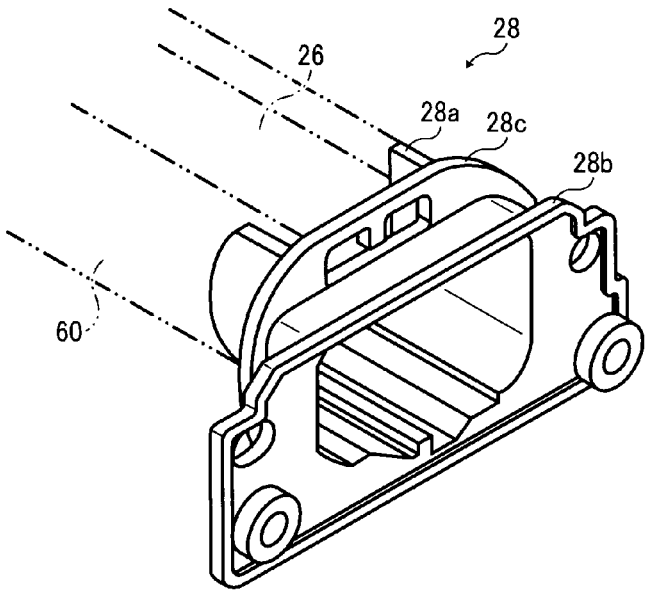
FIG. 12 is a perspective view of a mounting attachment during assembly with the belt holder and the fuser pad, included in the fixing device of FIG. 4.

With reference to FIG. 12, which is a perspective view of the mounting attachment 28 during assembly with the belt holder 60 and the fuser pad 26, the mounting attachment 28 is shown including a flange 28*b* adapted to be affixed to the frame 42 and having its interior wall shaped to retain longitudinal ends of respective pieces of fuser assembly in position, and a tubular insert 28*a* extending from the flange 28*b* to be inserted into the longitudinal end of the tubular belt holder 60. Also included is a collar 28*c* disposed around the insert 28*a* to contact the longitudinal end of the tubular belt holder 60 during assembly, and to restrict lateral displacement of the fuser belt 21 rotating around the belt holder 60 during operation.

The mounting attachment 28 serves to maintain the belt holder 60 in shape at the longitudinal end of the metal holder 60, where the circumferential dimension of the thin-walled tubular body 60 is susceptible to variations due to production tolerances during manufacture and deformation upon sliding contact with the fuser belt during operation, which would detract from performance of the fixing device. For reliable retention of the belt holder 60, the tubular potion 28*a* of the mounting attachment 28 has its outer circumferential dimension shaped in conformity with the inner circumferential dimension of the belt holder 60 with a clearance between the adjoining circumferential surfaces falling within approximately 0.15 mm or smaller.

The pressure roller 31 comprises a motor-driven, elastically biased cylindrical body formed of a hollowed core 32 of metal, covered with an intermediate layer 33 of elastic, thermally insulating material, such as silicone rubber or other solid rubber, approximately 2 mm to approximately 3 mm thick, and an outer layer 34 of release agent, such as a PFA layer formed into a tubular configuration, approximately 50 μm thick, deposited one upon another. The pressure roller 31 is equipped with a biasing mechanism that presses the cylindrical body against the fuser belt assembly, as well as a driving motor that imparts a rotational force or torque to rotate the cylindrical body. Optionally, the pressure roller 31 may have a dedicated heater, such as a halogen heater, accommodated in the hollow interior of the metal core 32.

According to this patent specification, the belt holder 60 has its circumferential dimension specially configured to provide a close, uniform contact between the fuser belt 21 and the belt holder 60 to effectively heat the belt 21 by conduction, while allowing for good separation of a recording sheet S from the belt holder 60 at the exit of the fixing nip N. A description now given of such special configuration of the belt holder 60 with continued reference to FIG. 4 and subsequent drawings.

As shown in FIG. 4, the tubular belt holder 60 includes, along a circumferential dimension thereof, an upstream, first circumferential portion P1 at which the belt holder 60 is subjected to heating by the heater 25 upstream from the fixing nip N, a downstream, second circumferential portion P2 at which the recording sheet S separates from the fuser belt 21 downstream from the fixing nip N, and a midstream, third circumferential portion P3 disposed upstream from the first circumferential portion P1 and downstream from the second circumferential portion P2, as well as an immediately upstream, fourth circumferential portion P4 disposed immediately upstream from the fixing nip N and downstream from the first circumferential portion P1, and a far downstream, fifth circumferential portion P5 disposed downstream from the second circumferential portion P2 and upstream from the third circumferential portion P3.

Figure 13:
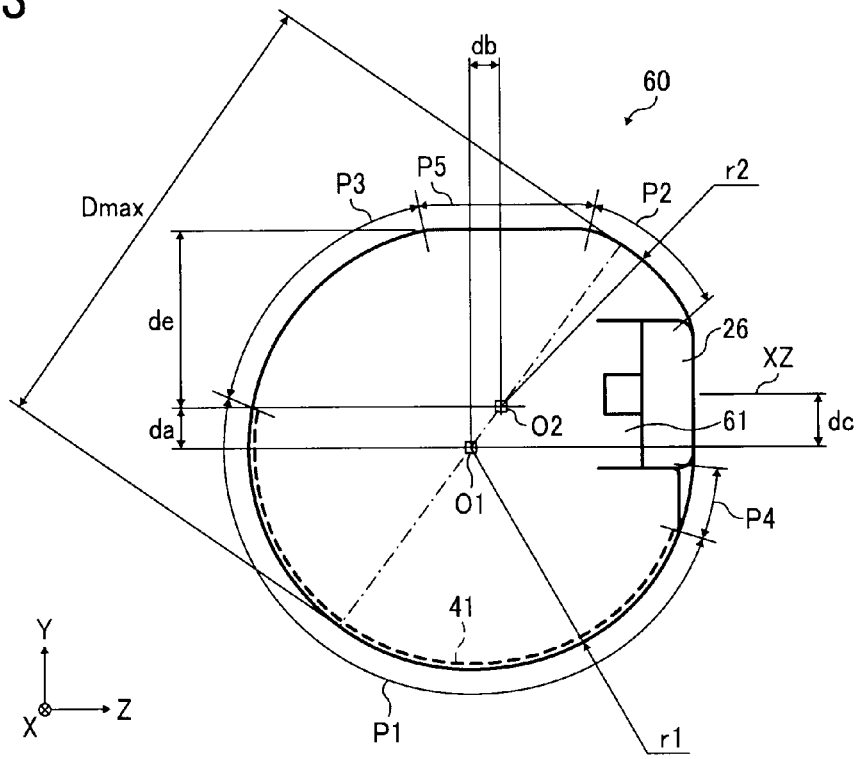
FIG. 13 is an end-on, axial view of the belt holder assembled with the fuser pad, shown with other surrounding components omitted.

FIG. 13 is an end-on, axial view of the belt holder 60 assembled with the fuser pad 26, shown with other surrounding components omitted, for illustrating in greater detail the special configuration of the belt holder 60.

As shown in FIG. 13, in the belt holder 60, the first circumferential portion P1 defines a first arc-shaped cross-section whose outer radius r1 is approximately equal to or smaller than an inner radius of the fuser belt 21 in the generally cylindrical configuration thereof, and whose center O1 is displaced, in the conveyance direction Y, away from a reference plane XZ containing the central axis of the fuser pad 26 and extending perpendicular to the conveyance direction Y. The second circumferential portion P2 defines a second arc-shaped cross-section whose outer radius r2 is dimensioned relative to the outer radius r1 of the first circumferential portion P1, and whose center O2 is displaced away from the center O1 of the first circumferential portion P1 toward the fixing nip N by a distance da in the conveyance direction Y and by a distance db in the load direction Z.

More specifically, a maximum diameter Dmax of the belt holder 60, as defined by a maximum distance between the outer surfaces of the first circumferential portion P1 and the second circumferential portion P2 (i.e., the length of a longest imaginary straight line connecting the outer circumferential surface of the first portion P1 to that of the second portion P2), is larger than the inner diameter, or twice the inner radius, of the fuser belt 21 in the generally cylindrical configuration thereof.

For example, where the inner radius of the fuser belt 21 is approximately 15 mm, the outer radius r1 of the first circumferential portion P1 may be approximately 14.5 mm, with a distance dc between the center O1 of the first circumferential portion P1 and the reference plane XZ being approximately 3.4 mm. In such cases, the outer radius r2 of the second circumferential portion P2 may be approximately 13 mm, the distance da between the centers of the first and second circumferential portions P1 and P2 in the conveyance direction Y be approximately 2.7 mm, and the distance db between the centers O1 and O2 of the first and second circumferential portions P1 and P2 in the load direction Z be approximately 2 mm, yielding a belt holder maximum diameter Dmax of approximately 30.86 mm, which is larger than the inner diameter (i.e., approximately 30 mm) of the fuser belt 21.

As used herein, the terms "upstream", "downstream", and "midstream", when used in connection with the circumferential portions of the belt holder 60, refer to positions relative to the fixing nip N in the circumferential, rotational direction C of the fuser belt 21, so that the fuser belt 21, during one rotation around the belt holder 60, first enters the nip N from the upstream portion, exits the nip N to enter the downstream portion, then proceeds to the midstream portion to again reach the upstream portion. The term "reference plane XZ" refers to an imaginary plane containing the central axis of the fuser pad 26 and extending perpendicular to the conveyance direction Y as set forth herein, which can be used as a reference for determining relative positions of points, lines, and areas, in particular, the centers or central axes of the circumferential portions, of the belt holder 60 in cross-section of the fuser assembly.

Also, dimensions of a fixing member formed of elastic or flexible material are defined as those measured where such a flexible fixing member retains its original, designed shape before assembly into the fixing device. Thus, the inner radius of the fuser belt 21 is defined as a length of a straight line segment that joins the central axis of the tubular body with any point on its inner circumferential surface, measured where the fuser belt 21 retains its generally cylindrical configuration before assembly with the belt holder 60. The inner diameter of the fuser belt 21 may be obtained accordingly from the inner radius as set forth herein.

In such a configuration, the tubular belt holder 60 can maintain tension on the fuser belt 21 entrained therearound owing to the first circumferential portion P1 having its outer radius r1 approximately equal to the inner radius R of the fuser belt 21, and its center O1 displaced, in the conveyance direction Y, away from the reference plane XZ. The flexible fuser belt 21, thus entrained under tension, stretches from the upstream, first circumferential portion P1 toward the fixing nip N during rotation around the belt holder 60, so as to establish a close, uniform contact with the belt holder 60 with substantially no spacing left between the adjoining surfaces of the belt 21 and the belt holder 60.

Also, designing the belt holder 60 with substantial equality between the outer and inner radii of the first circumferential portion P1 and the fuser belt 21 prevents undue stress and concomitant deformation on the fuser belt 21, so that the belt 21 can maintain its original, generally cylindrical configuration to more closely and uniformly contact the belt holder 60 along the first circumferential portion P1. For proper movement of the fuser belt 21 around the belt holder 60, the outer radius r1 of the first circumferential portion P1 is smaller than the inner radius of the fuser belt 21 by a difference not exceeding approximately 2 millimeters.

Further, dimensioning the belt holder 60 with its maximum diameter Dmax greater than the inner diameter of the fuser belt 21 causes the fuser belt 21 to stretch across the opposed circumferential portions P1 and P2, so as to more closely and uniformly contact the belt holder 60 along the first circumferential portion P1 with effectively reduced spacing between the adjoining surfaces of the belt 21 and the belt holder 60.

Hence, the fixing device 20 according to this patent specification provides a thermally efficient, reliable fixing process owing to the special configuration of the belt holder 60, wherein maintaining a close, uniform contact between the fuser belt 21 and the belt holder 60 along the upstream circumferential portion P1 at which the belt holder 60 is subjected to heating allows for efficient thermal conduction between the belt holder 60 and the fuser belt 21, leading to a thermally efficient fixing process with a reduced warm-up time and first-print time, while preventing the belt holder 60 from overheating where the fuser belt 21 is heated without rotation (e.g., upon start-up), which would otherwise cause premature deterioration of the coating layers 21*a* and 60*a* on the belt and holder circumferential surfaces.

In further embodiment, the outer radius r2 of the second circumferential portion P2, which is suitably dimensioned with respect to the outer radius r1 of the first circumferential portion P1, may be smaller than the outer radius r1 of the first circumferential portion P1, so that the belt holder 60 exhibits a greater curvature at the downstream portion P2 than at the upstream portion P1 along its circumferential dimension.

Such arrangement allows for reliable conveyance of recording sheets S downstream from the fixing nip N, where the fuser belt 20 moving along the increased curvature of the circumferential portion P2 can immediately separate from the recording sheet S, which then proceeds properly without adhering to the fuser belt 21 at the exit of the fixing nip N.

Further, the third circumferential portion P3 of the belt holder 60 defines a third, arc-shaped cross-section whose radius r3 is approximately equal to the outer radius r1 of the first circumferential portion P1, and whose center is positioned coextensive with the center O1 of the first circumferential portion P1.

Such arrangement allows for efficient, cost-effective production of the belt holder 60, where the adjoining circumferential portions of the metal-worked tubular body, having identical curvatures, are more ready to process than those having different, irregular curvatures.

Alternatively, instead of configuring the first and third circumferential portions P1 and P3 equidistant from their common center point O1, the arc-shaped cross-section of the third circumferential portion P3 may be located closer to the center O1 of the first circumferential portion P1 than is the first arc-shaped cross-section of the first circumferential portion P1, insofar as the third circumferential portion P3 does not interfere with the reinforcing member 23 inside the belt holder 60.

Such arrangement allows for reliable conveyance of recording sheets S through the fixing nip N, wherein the belt holder 60 does not contact the fuser belt 21 at the third circumferential portion P3, so that the friction between the belt 21 and the holder 60 is smaller than that between the belt 21 and the recording sheet S, which prevents the incoming sheet S from incidentally slipping off the belt surface at the fixing nip N. Also, designing the third circumferential portion P3 with a smaller dimension results in a reduced amount of material and cost required for producing the tubular belt holder 60.

Still further, the fourth circumferential portion P4 of the belt holder 60 defines a fourth, generally flattened cross-section located closer to the center O1 of the first circumferential portion P1 than is the first arc-shaped cross-section of the first circumferential portion P1. The fourth circumferential portion P4 thus has a smaller curvature than that of the first circumferential portion P1, which connects the first circumferential portion P1 to the side slot 61 of the belt holder 60.

Such arrangement prevents the fuser belt 21 from elevating away from the belt holder 60 immediately upstream from the fixing nip N, thereby ensuring that the belt 21 properly enters the fixing nip N and introduces the recording sheet S along its outer circumferential surface.

Yet still further, the fifth circumferential portion P5 of the belt holder 60 defines a fifth, generally flattened cross-section along which the fuser belt 21 during rotation is movable away from contact with the belt holder 60. The fifth circumferential portion P5 is at a distance de, shorter than the inner radius of the fuser belt 21, away from the center O2 of the second circumferential portion P2. For example, where the fuser belt 21 has an inner radius of approximately 15 mm in its generally cylindrical configuration, the distance de between the fifth circumferential portion P5 and the center O2 of the second circumferential portion P2 is approximately 11.5 mm in the conveyance direction Y.

Such arrangement prevents undue friction between the fuser belt 21 and the belt holder 60 far downstream from the fixing nip N, at which a close contact between the adjoining surfaces of the belt 21 and the holder 60 is no longer necessary, unlike the case for the first circumferential portion P1 conducting heat to the fuser belt 21 upstream from the fixing nip N.

Still further, the belt holder 60 may have its inner circumferential surface, in particular, that of the first circumferential portion P1, coated with a black, absorptive material 41.

Such arrangement causes the belt holder 60 to exhibit high emissivity when subjected to radiation, allowing for high thermal efficiency in heating the fuser belt 21 by radiating the belt holder 60 with the radiant heater 25.

Yet still further, the belt holder 60 and the fuser pad 26 may together form an assembled cylindrical structure that has a closed, outer circumference La smaller than an inner circumference Lb of the fuser belt 60 in the generally cylindrical configuration thereof, with a difference Lb-La between the outer circumference of the assembled cylindrical structure and the inner circumference of the fuser belt 21 being within a range from approximately 0.5 mm to approximately 0.9 mm, preferably, within a range from approximately 0.6 mm to approximately 0.8 mm, and more preferably, equal to approximately 0.7 mm.

Too long a differential length Lb-La causes an excessive slack in the fuser belt 21 around the belt holder 60, resulting in overheating of the belt holder 60 due to a loss of contact between the belt 21 and the belt holder 60, which would adversely affect durability of the coating layer 60*a* on the outer circumferential surface of the belt holder 60. Contrarily, too short a differential length Lb-La translates into an excessive tension on the fuser belt 21 around the belt holder 60, resulting in an excessive frictional resistance between the fuser belt 21 and the belt holder 60, which would not only affect proper rotation of the fuser belt 21, but also induce slippage of the pressure roller 31 and the recording sheet S with respect to the moving fuser belt 21 at the fixing nip N.

Thus, maintaining the differential length Lb-La within a moderate, appropriate range prevents failures of the fixing device caused by excessive slack or tension in the fuser belt 21 entrained around the belt holder 60. The differential length Lb-La between the adjoining surfaces of the pad/holder assembly and the fuser belt 21 may be determined where at least one of the outer circumferential surface of the belt holder 60 and the inner circumferential surface of the fuser belt 12 is provided with a coating layer, and where the fixing device 20 includes a lubricant deposited between the outer circumferential surface of the belt holder 60 and the inner circumferential surface of the fuser belt 21.

Although the fuser assembly in the present embodiment is depicted with specific ranges for the differential length Lb-La, the appropriate range for the differential length Lb-La may be other than those described herein depending on specific configurations, with consideration given to the thicknesses of the coating layers 21*a* and 60*a* and the lubricant agent 40, as well as the shape and dimensions of the respective components of the fuser assembly.

Experiments have been conducted to evaluate effects of the differential length Lb-La between the circumferences of the fuser belt 21 and the belt holder 60 on the performance of the fixing device 20, in which an operational temperature T at the surface of the belt holder 60 and a friction F between the adjoining surfaces of the fuse belt 21 and the belt holder 60 were measured with varying differential lengths Lb-La in a fixing device similar to that depicted above primarily with reference to FIG. 4.

Figure 14:
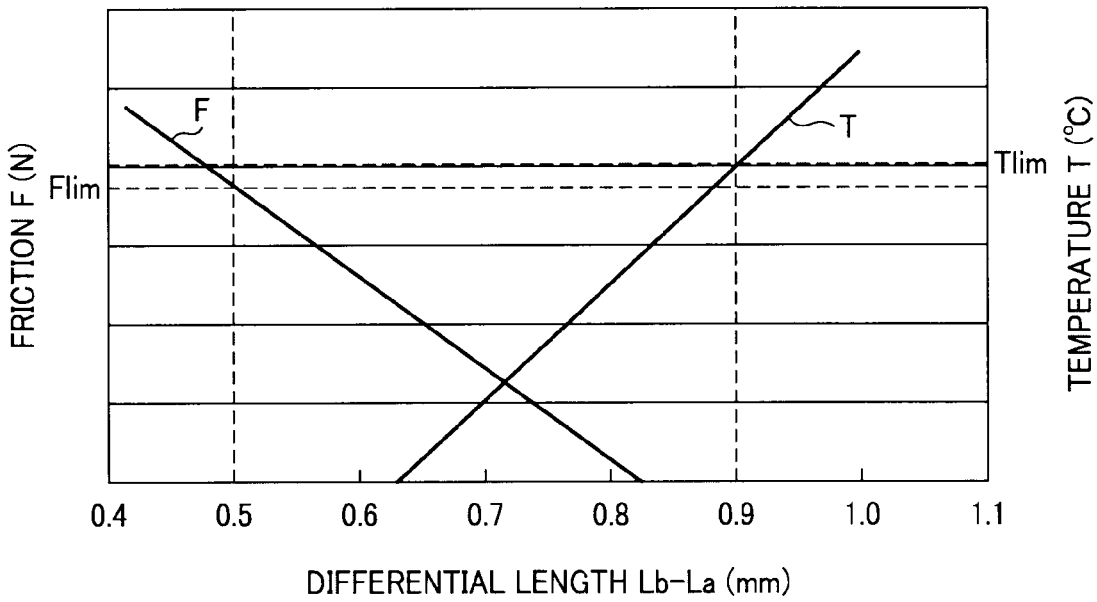
FIG. 14 shows graphs of measurements of an operational temperature, in degrees Celsius, and a friction, in Newtons, between belt and holder circumferential surfaces obtained through experiments, each plotted against a differential length, in millimeters.

Results of such experiments are shown in FIG. 14, which provides measurements of the operational temperature T, in degrees Celsius, and the friction F, in Newtons, between the belt and holder circumferential surfaces, each plotted against the differential length Lb-La, in millimeters.

As shown in FIG. 14, the operational temperature T increases as the differential length Lb-La increases, whereas the friction F increases as the differential length Lb-La decreases. The rise in the operational temperature T is attributable to the fact that increasing the differential length Lb-La causes an increased slack in the fuser belt 21, resulting in a partial loss of contact between the belt 21 and the belt holder 60 and concomitant local, intensive heating in the fuser belt 21 around the belt holder 60. On the other hand, the rise in the friction F is attributable to the fact that decreasing the differential length Lb-La causes an increased tension in the fuser belt 21, which thus experiences an increased frictional resistance during rotation around the belt holder 60.

Specifically, at a differential length Lb-La of approximately 0.9 mm, the operational temperature T exceeds a maximum allowable temperature limit Tlim, to which the belt holder 60 can be heated without significantly damaging the coating layer 60*a*. That is, increasing the differential length Lb-La over approximately 0.9 mm causes the operational temperature T to exceed the maximum allowable limit Tlim, which would adversely affect durability of the coating layer 60*a* on the outer circumferential surface of the belt holder 60.

At a differential length Lb-La of approximately 0.5 mm, the friction F exceeds a maximum allowable friction limit Flim with which the fuser belt 21 can properly rotate around the belt holder 60 without causing slippage of the pressure roller 31 and the recording sheet S against the rotating belt 21. That is, decreasing the differential length Lb-La below approximately 0.5 mm causes the friction F to exceed the maximum allowable limit Flim, which would not only affect proper rotation of the fuser belt 21, but also induce slippage of the pressure roller 31 and the recording sheet S with respect to the moving fuser belt 21 at the fixing nip N.

The experimental results above demonstrate that setting the differential length Lb-La in the range of approximately 0.5 mm to approximately 0.9 mm is effective in preventing damage to the coating layer 60*a* due to overheating, and providing proper rotation of the fuser belt 21 without slippage of the pressure roller 31 and the recording sheet S. More effective fixing performance can be obtained by keeping the differential length Lb-La in the range of approximately 0.6 mm to approximately 0.8 mm, preferably equal to approximately 0.7 mm.

As mentioned earlier, the mounting attachment 28 included in the fixing device 20 comprises a flanged tubular piece of suitable material provided to a longitudinal end of the tubular belt holder 60 to allow detachable attachment and retention of the belt holder end to the sidewall or frame 42 of the fixing device 20, wherein the attachment 28 is inserted into the longitudinal end of the tubular belt holder 60 around which the fuser belt 21 is rotatably entrained, while retaining the longitudinal ends of the fuser pad 26, the inner retaining stay 70, the reinforcing member 23, and the heater 25 in position inside the loop of the fuser belt 21, which allows assembly of the belt holder 60 with the separate pieces of fuser equipment to form a single, integrated unit detachably attachable to the frame 42 of the fixing device 20 during mounting into the image forming apparatus 1.

Figure 15A:
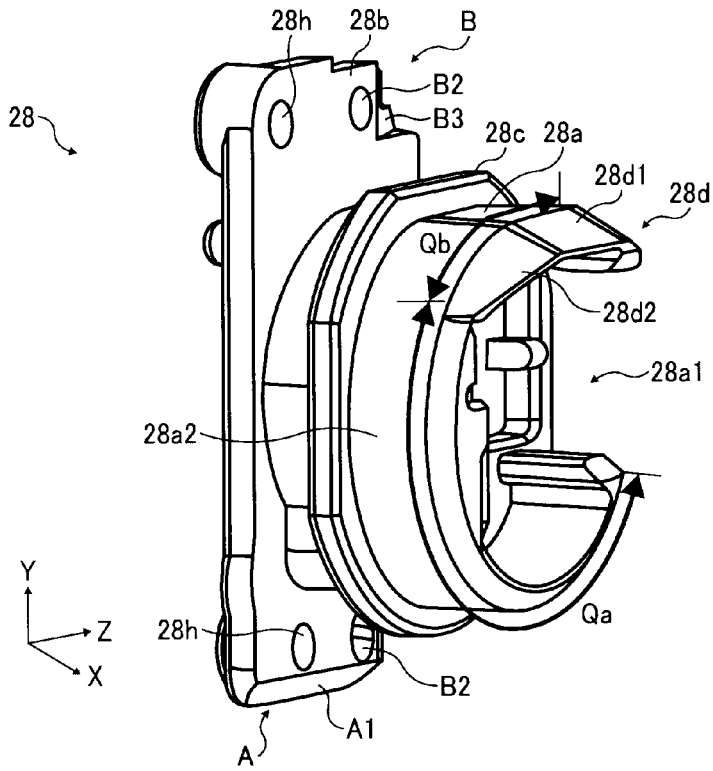
FIGS. 15A and 15B are perspective views taken from opposed sides of a mounting attachment for the belt holder before assembly into the fixing device of FIG. 4.
Figure 15B:
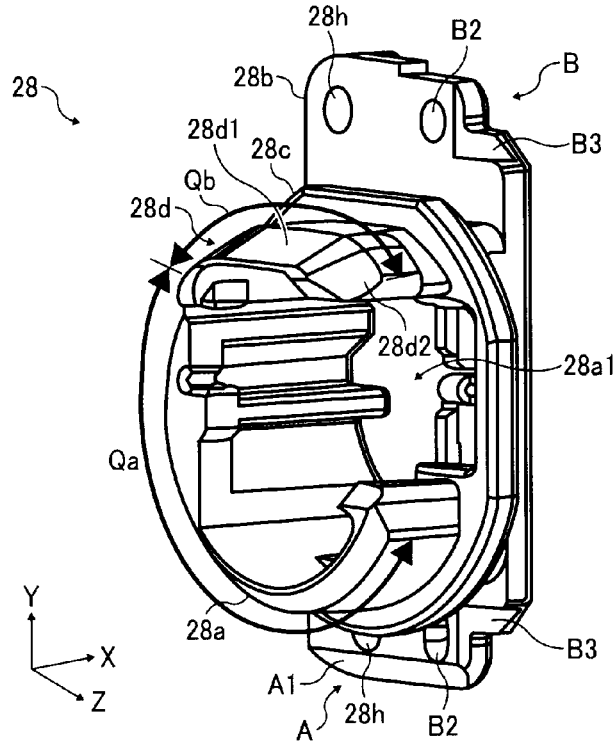

With reference to FIGS. 15A and 15B, which are perspective views taken from opposed sides of the mounting attachment 28 before assembly, the attachment 28 is shown including the flange 28*b* adapted to be affixed to the frame 42, the tubular insert 28*a* extending from the flange 28*b* to be inserted into the longitudinal end of the tubular belt holder 60, and the collar 28*c* disposed around the insert 28*a*. Since the pair of attachments 28 provided to the opposed longitudinal ends of the fuser belt assembly is symmetrical in shape and uniform in size, except where each is designed to fit a particular sidewall 42 of the fixing device 20, the following describes configuration and operation of only one mounting attachment, and a description of another will be omitted for brevity.

Specifically, the flange 28*b* of the attachment 28 is a generally planar piece of material extending in the directions Y and Z perpendicular to the axial direction X, with one or more screw holes 28*h* defined therein for screwing onto the sidewall 42. The flange 28*b* may have its interior wall shaped to conform to the longitudinal ends of the fuser pad 26, the reinforcing member 23, and the heater 25, so as to retain these elongated fixing members in position inside the loop of the fuser belt 21.

The tubular insert 28*a* is a generally tubular portion extending in the axial direction X from the major plane of the flange 28*b*, having a diameter dimensioned relative to the inner diameter of the belt holder 60 for fitting the longitudinal end of the belt holder 60 with an extremely small space of, for example, approximately 0.15 mm or smaller, left between the adjoining circumferential surfaces of the insert 28*a* and the holder 60.

The collar 28*c* is a generally annular piece of material surrounding the tubular insert 28*a*. The collar 28*c* serves to contact the longitudinal end of the tubular belt holder 60 during assembly, and to restrict lateral displacement of the fuser belt 21 rotating around the belt holder 60 during operation.

More specifically, the tubular insert 28*a* has an opening 28*a*1 extending partially circumferentially therearound, through which the longitudinal end of the fuser pad 26 is accommodated and retained in contact with the flange 28*b*. Where the belt holder 60 is provided with an inwardly extending wall or side slot 61 in one side thereof for accommodating the fuser pad 26 therein, as is the case with the embodiment depicted primarily with reference to FIG. 4, the opening 28*a*1 engages such inward extension of the belt holder 60 together with the fuser pad 26 accommodated therein. Also, the inner retaining stay 70 provided around the side slot 61 of the belt holder 60 may have its flanged, longitudinal end 70*b* retained in contact with the flange 28*b*.

The tubular insert 28*a* has its outer circumferential surface precisely shaped into a semi-cylindrical configuration along an upstream circumferential portion Qa adjoining the opening 28*a*1 for retaining therearound the longitudinal end of the belt holder 60 in its desired, generally cylindrical configuration. Upon completion of the fuser belt assembly, the upstream circumferential portion Qa is positioned upstream from the fixing nip N in the circumferential direction C, which corresponds to at least the first, upstream circumferential portion P1 of the belt holder 60 subjected to heating by the heater 25. The upstream circumferential portion Qa of the tubular insert 28*a* may have its distal edge beveled or chamfered for facilitating insertion into the tubular belt holder 60.

During assembly, an operator provides a mounting attachment 28 to one longitudinal end of the tubular belt holder 60, retained in its generally cylindrical configuration with the inner and outer retaining stays 70 and 71, by forcing the tubular insert 28*a* into the interior of the belt holder 60 until the collar 28*c* contacts the longitudinal end of the belt holder 60.

Then, the fuser belt 21 is entrained around the belt holder 60, followed by inserting, from a side opposite that the attachment 28 is provided, the fuser pad 26 into the side slot 61 of the belt holder 60, and the reinforcing member 23 and the heater 25 both into the interior of the belt holder 60, so that the respective ends of the inserted members each contacts the interior wall of the attachment flange 28*b*.

With the belt holder 60 thus combined with the fuser belt 21 and the other pieces of the fuser belt assembly via the attachment 28, the operator then provides another mounting attachment 28 to an opposite longitudinal end of the belt holder 60, in the manner similar to that described above, thereby obtaining a complete fuser belt assembly ready for installation into the fixing device 20.

The inventors have recognized that forcing the tubular attachment 28 into the tubular belt holder 60 with extremely small spacing between the circumferential surfaces of the attachment 28 and the holder 60 requires substantial effort and skills of an human operator handling the fuser belt assembly, leading to lengthy and cumbersome manufacturing process and possible damage to the belt holder and adjoining structure. This is particularly true where the tubular belt holder 60, which is typically formed of a thin-walled piece of metal, has an asymmetrical, non-circular cross section for obtaining high thermal efficiency in heating the fuser belt assembly, which makes it more difficult to introduce the attachment 28 into the belt holder 60 than would be the case with a metal tube of a simple, true-circular cross section.

To overcome these and other difficulties encountered during assembly of a belt-based fixing device, the mounting attachment 28 for the tubular belt holder 60 according to this patent specification is specially configured to facilitate installation of the fuser belt assembly in the fixing device 20. A detailed description is now given of such special configuration of the mounting attachment 28, with continued reference to FIGS. 15A and 15B and subsequent drawings.

As shown in FIGS. 15A and 15B, the tubular insert 28*a* of the mounting attachment 28 has a free axial end thereof at least partially protruding and tapered to form a tapered guide surface 28*d*, along which an inner circumferential surface of the tubular belt holder 60 is slidably guided onto an outer circumferential surface of the insert 28*a* during insertion into the longitudinal end of the tubular belt holder 60.

Specifically, the tapered guide surface 28*d* extends from a downstream circumferential portion Qb opposite to, and different from, the precisely shaped, upstream circumferential portion Qa of the tubular insert 28*a*. Upon completion of the fuser belt assembly, the downstream circumferential portion Qb is positioned downstream from the fixing nip N in the circumferential direction C, which corresponds to at least the fifth, planar circumferential portion P5 of the belt holder 60. That is, the downstream circumferential portion Qb may encompass those portions of the belt holder 60 opposite the first circumferential portion P1 across the reinforcing member 23, including not only the fifth circumferential portion P5, but also adjoining parts of the second and fourth circumferential portions P2 and P4 depending on specific configuration of the fuser belt assembly.

Figure 16:
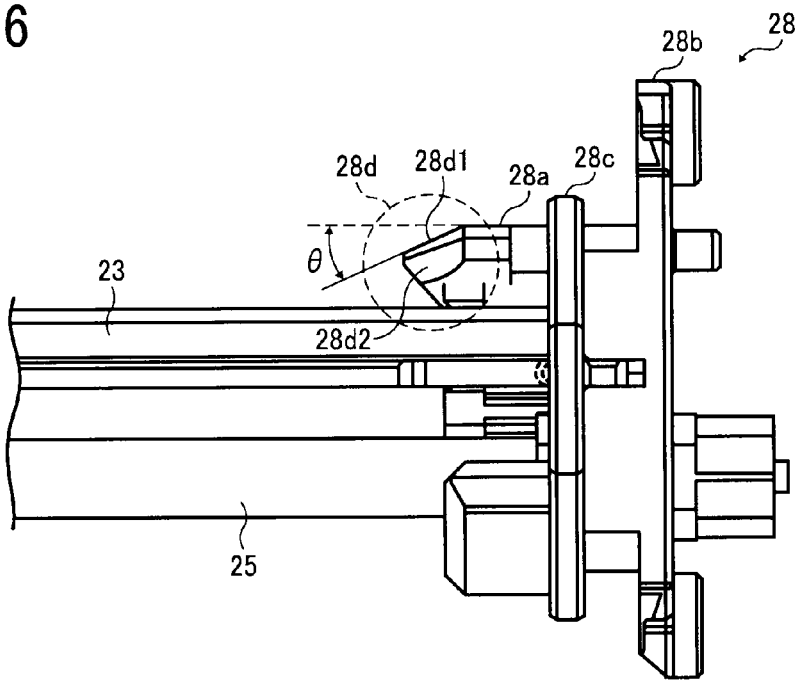
FIG. 16 is a side-elevational view of the mounting attachment of FIGS. 15A and 15B, assembled with the reinforcing member and the heater.
Figure 17:
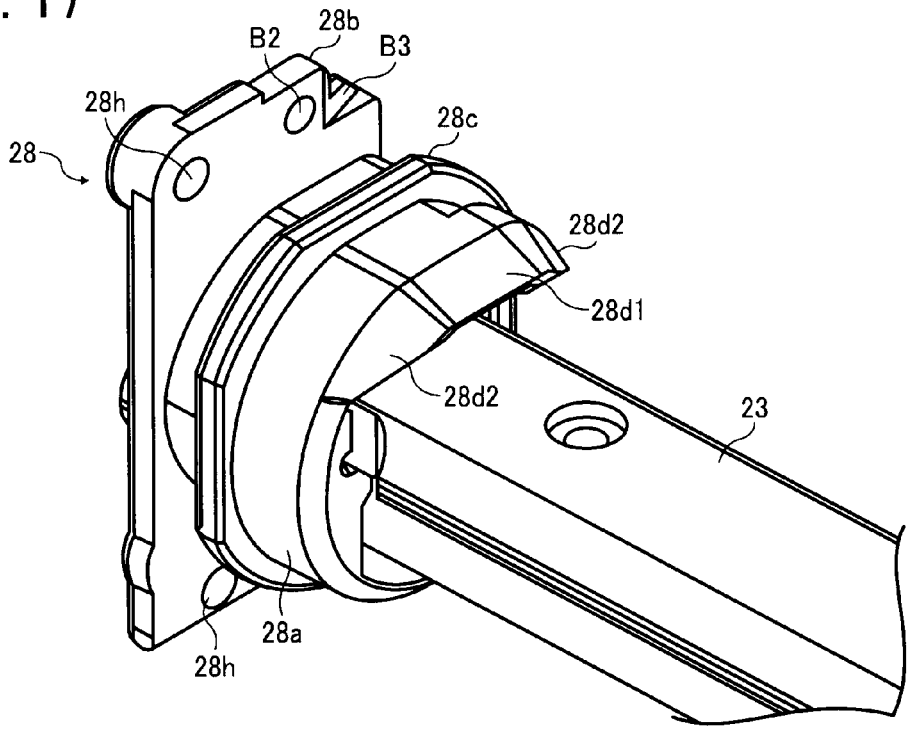
FIG. 17 is a perspective view of the mounting attachment of FIGS. 15A and 15B, assembled with the reinforcing member and the heater.

More specifically, with additional reference to FIGS. 16 and 17, which are side-elevational and perspective views of the mounting attachment 28 assembled with the reinforcing member 23 and the heater 25, the tapered guide surface 28*d* is shown consisting of a first, central surface 28*d*1 and a pair of second, adjoining surfaces 28*d*2 on opposed sides of the first surface 28*d*1.

Each of the first and second surfaces 28*d*1 and 28*d*2 is inclined at an angle θ of, for example, approximately 30° to approximately 45° with respect to an imaginary plane parallel or tangential to the circumferential surface of the tubular insert 28*a*. The first surface 28*d*1 tapers in the axial direction X and has a substantially uniform depth in the circumferential direction C, whereas the second surface 28*d*2 tapers not only in the axial direction X but also in the circumferential direction C, so that the depth of the tapered guide surface 28*d* is greatest at the first surface 28*d*1 and becomes narrower toward the distal end of the second surface 28*d*2. In the present embodiment, the first surface 28*d*1 is substantially planar and exhibits no curvature in the circumferential direction C insofar as it extends from the planar portion of the tubular insert 28*a* corresponding to the planar circumferential portion P5 of the belt holder 60.

During assembly, the tubular insert 28*a* is inserted into the longitudinal end of the belt holder 60 with the distal edge of the first inclined surface 28*d*1 sliding against the inner circumferential surface of the belt holder 60. As the insert 28*a* is pushed forward into the belt holder 60, the distal edges of the second inclined surfaces 28*d*2 start sliding against the inner circumferential surface of the belt holder 60, so that gradually increasing circumferential lengths or areas of the first and second surfaces 28*d*1 and 28*d*2 are brought into sliding contact with the inner circumferential surface of the belt holder 60. Such sliding contact with the tapered guide surface 28*d* guides the inner circumferential surface of the belt holder 60 onto the circumferential surface of the tubular insert 28*a*, resulting in proper relative positioning of the belt holder 60 and the mounting attachment 28 with extremely small spacing between their adjoining circumferential surfaces.

Figure 18:
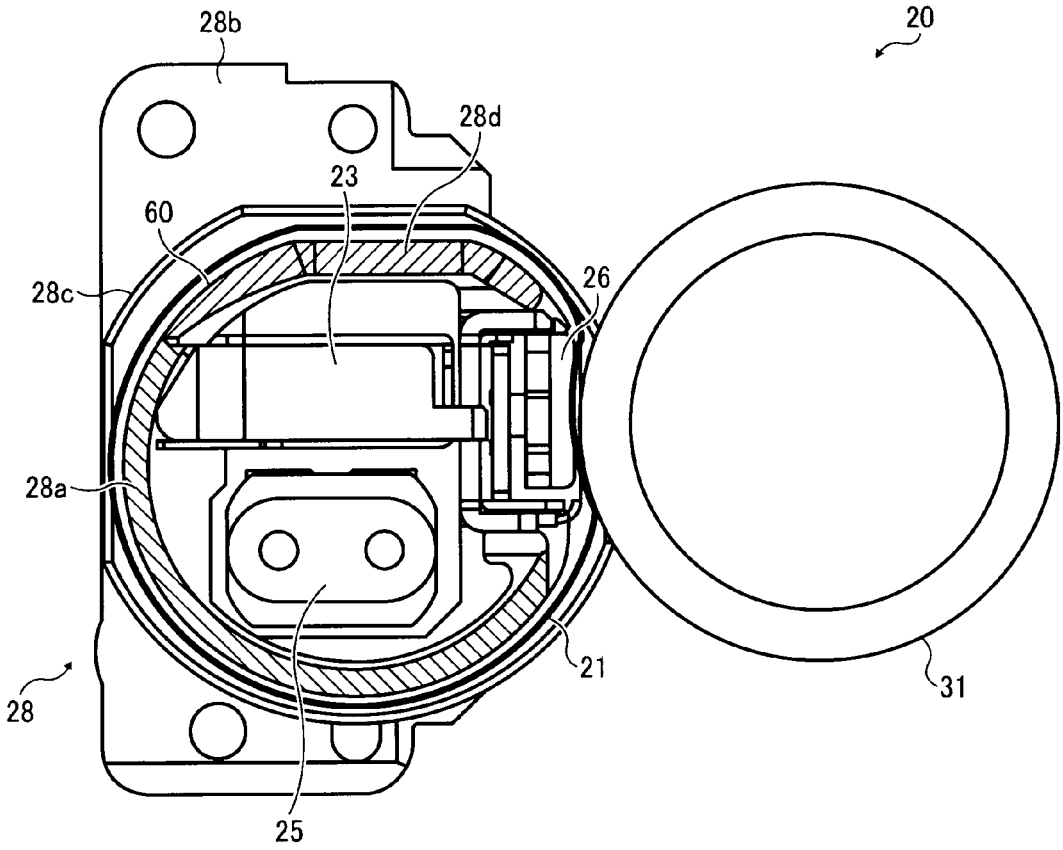
FIG. 18 is an end-on, axial cutaway view of a complete fuser belt assembly mounted in position relative to a pressure member included in the fixing device of FIG. 4.

Thereafter, the mounting attachment 28 is connected with the fuser pad 26, the reinforcing member 23, and the heater 25, each of which is inserted into the belt holder 60 with its longitudinal end retained on the interior wall of the flange 28*b*, as well as the fuser belt 21 entrained around the belt holder 60, followed by providing another mounting attachment 28 to the opposite longitudinal end of the belt holder 60 in the manner similar to that depicted above. The complete fuser belt assembly thus obtained is subsequently mounted in position relative to the pressure roller 31 in the fixing device 20, as shown in FIG. 18.

Thus, provision of the tapered guide surface 28*d* facilitates insertion of the tubular insert 28*a* into the tubular belt holder 60, since it enables the inner circumferential surface of the belt holder 60 to establish sliding contact initially with only a selected circumferential portion of the tapered guide surface 28*d*, instead of the entire circumference of the tubular insert, followed by increasing areas of contact with the tapered guide surface 28*d* as the insert 28*a* is pushed forward into the belt holder 60, resulting in reduced mechanical stress and concomitant deformation in cross section of the thin-walled tubular body during assembly.

Moreover, positioning the tapered guide surface 28*d* along the downstream circumferential portion Qb of the tubular insert 28*a* isolates the inwardly protruding surface 28*b* from radiation of the heater 25 inside the tubular belt holder 60. Such arrangement prevents the mounting attachment 28 from absorbing undue heat or radiation from the heater 25, which would otherwise not only hinder heating of the belt holder 60 but also cause deformation or other failure due to localized overheating in the mounting attachment 28.

Figure 19:
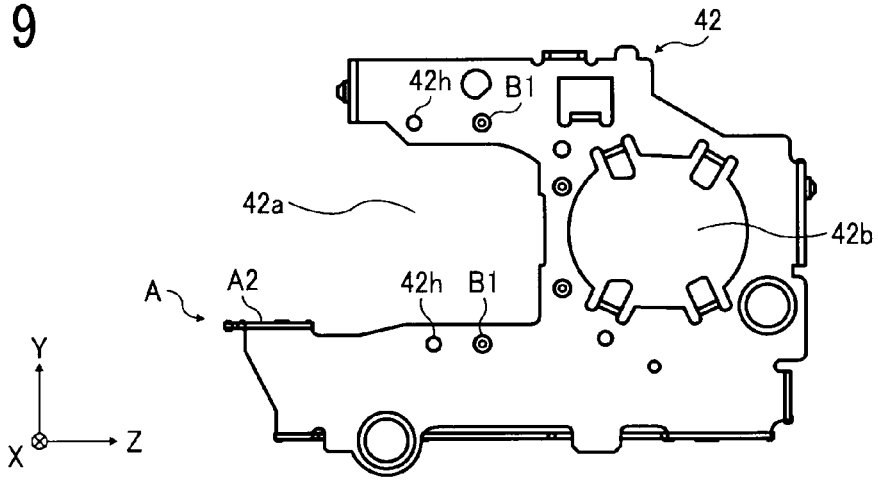
FIG. 19 is an elevational view of a frame of the fixing device of FIG. 4.

FIG. 19 is an elevational view of the frame or sidewall 42 of the fixing device 20 before assembly.

As shown in FIG. 19, the sidewall 42 is a generally planar, bored slotted piece of material extending in the directions Y and Z perpendicular to the axial direction X, with a pair of first and second mounting bores 42*a* and 42*b* defined therein, the former for accommodating the longitudinal end of the fuser belt 21 provided with the mounting attachment 28, and the latter for accommodating the longitudinal end of the pressure roller 31.

Specifically, the first mounting bore 42*a* is an open-sided hole that is open on a side opposite the second bore 42*b* for allowing insertion of the fuser belt assembly in the load direction Z during mounting to the fixing device 20. One or more screw holes 42*h* are defined in the sidewall 42 adjacent to the first bore 42*a* for screwing the mounting attachment 28 onto the sidewall 42. The second mounting bore 42*b* may be provided in a suitable configuration depending on the design of the pressure member 31 employed.

The fuser belt assembly is mounted to the sidewalls 42 of the fixing device 20 with spacing between opposed surfaces of the mounting attachment 28 and the belt holder 60 in the axial direction X, or more precisely, between the collar 28*c* of the attachment 28 and the longitudinal end of the belt holder 60. This space or clearance is intended to accommodate deformation in the axial direction X of the belt holder 60 due to thermal expansion of the metal body being heated during operation, which would otherwise causes damage due to interference between the adjoining surfaces of the belt holder 60 and the attachment 28.

In general, such spacing is created where a human operator, having connected the mounting attachment 28 to the end of the tubular belt holder 60 with no spacing between the holder edge and the attachment collar 28*c*, moves the attachment 28 relative to the belt holder 60 in the axial direction to slightly withdraw the tubular insert 28*a* from the belt holder 60, so as to leave a space between the holder end and the attachment collar 28*c* upon mounting the fuser belt assembly to the sidewall 42 of the fixing device 20. Such manual spacing between the attachment 28 and the belt holder 60, however, requires the operator to exercise great care and attention not to excessively pull out the tubular insert 28*a* from the belt holder 60 to eventually cause disengagement and concomitant damage to the assembly, resulting in slow production rate and low serviceability of the fixing device.

In further embodiment, the fixing device 20 includes a guiding mechanism A provided between the flange 28*b* of the attachment 28 and the frame or sidewall 42 for guiding the attachment 28 into position on the frame 42, while positioning the attachment 28 relative to the belt holder 60 connected thereto, so as to create a space or clearance between opposed surfaces of the attachment 28 and the belt holder 60 in the axial direction X. Also included is a positioning mechanism B provided between the attachment 28 and the frame or sidewall 42 for positioning the attachment 28 relative to the sidewall 42 as the flange 28*b* slides against the sidewall 42 generally in a direction perpendicular to the axial direction X.

Specifically, with further reference to FIGS. 15A and 15B, the guiding mechanism A is shown including a beveled edge A1 formed on the flange 28*b* of the attachment 28, and the positioning mechanism B including one or more positioning holes B2 defined in the flange 28*b*, and one or more slopes B3 adjacent to the hole B2 in the flange 28*b*. With additional reference to FIG. 19, the guiding mechanism A is shown also including a contact edge A2 formed on the sidewall 42, and the positioning mechanism B also including one or more positioning protrusions B1 on the sidewall 42.

More specifically, in the positioning mechanism A, the beveled edge A1 defines an inclined surface that extends in an angled, oblique direction with respect to the axial direction X. In the present embodiment, the bevel A1 is disposed along an edge of the flange 28*b* extending in the load direction Z (i.e., the bottom edge in the drawings), defining an inclined surface at an angle of approximately 30° to approximately 45° with respect to the major plane of the flange 28*b* to which the tubular insert 28*a* is provided.

The contact edge A2 may be any structure formed on the sidewall 42 which defines an elongated edge or surface extending in a direction perpendicular to the axial direction X. For example, the contact edge A2 may be formed by cutting or bending an edge of the frame material. In the present embodiment, the contact A2 is disposed along an edge extending in the load direction Z on the open side of the first mounting bore 42*a* into which the longitudinal end of the fuser belt assembly is accommodated.

In the positioning mechanism B, the positioning protrusions B1 each is disposed adjacent to the first mounting bore 42*a* of the sidewall 42, extending in the axial direction X from the major plane of the sidewall 42 which extends in the directions Y and Z perpendicular to the axial direction. For obtaining precise positioning in the fuser belt assembly, the positioning protrusion B1 may be integrally formed in the sidewall 42 to minimize tolerance stack-up. For example, the positioning protrusion B1 may be shaped in a bell-shaped or other suitable configuration, obtained by processing a metal sheet through embossing or similar metal working processes.

The positioning holes B2 each is disposed adjacent to a peripheral edge of the flange 28*b* to engage the positioning protrusion B1 for establishing a proper operational position of the attachment 28.

The slope B3 is defined between the positioning hole B2 and the peripheral edge of the flange 28*b*, along which the positioning protrusion B1 is slidably guided into the positioning hole B2 as the flange 28*b* slides against the frame or sidewall 42 generally in the direction perpendicular to the axial direction X. The slope B3 in the present embodiment comprises a beveled edge whose thickness decreases in the load direction Z away from the positioning hole B2 toward the peripheral edge of the flange 28*b*, so as to guide the protrusion B1 from the flange periphery into the hole B2 as the flange 28*b* slides in the load direction Z along the sidewall 42.

Figure 20A:
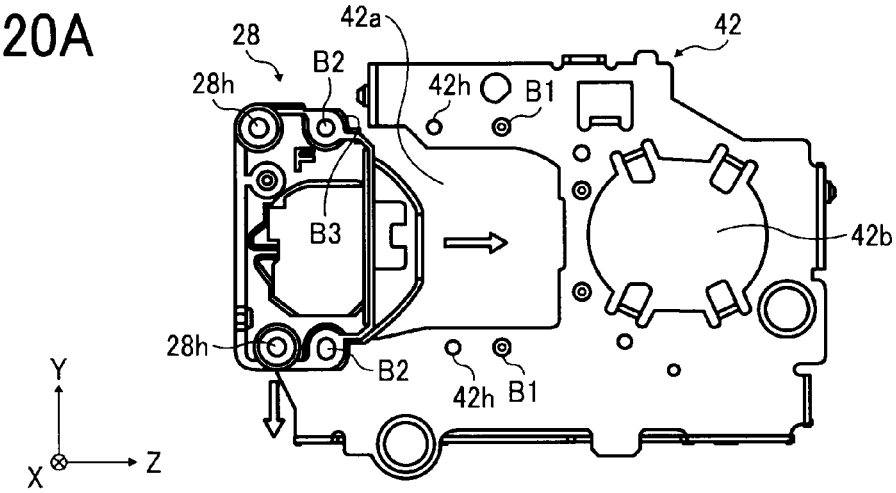
FIGS. 20A and 20B are side-elevational views of the fuser belt assembly during and after mounting, respectively, to the frame of FIG. 19.
Figure 20B:
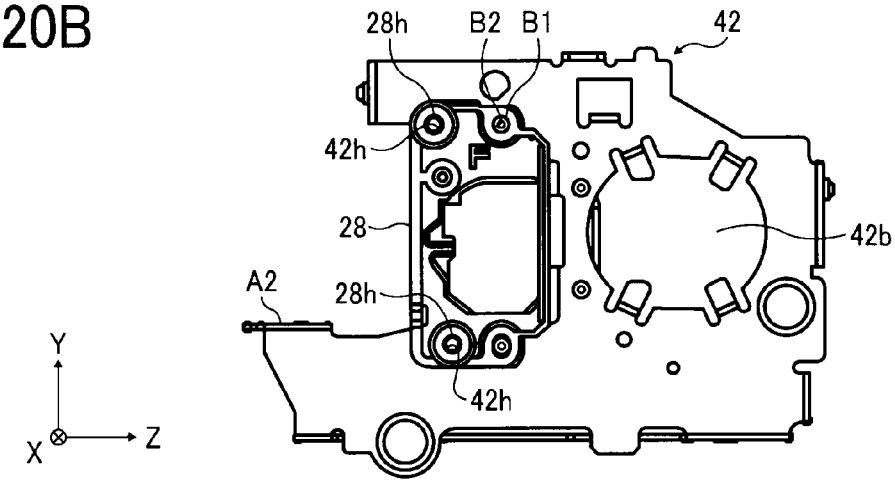

FIGS. 20A and 20B are side-elevational views of the fuser belt assembly during and after mounting, respectively, to the sidewall 42.

As shown in FIG. 20A, to mount the fuser belt assembly, an operator initially positions each longitudinal end of the assembly provided with the mounting attachment 28 on the open side of the mounting bore 42*a* of the corresponding sidewall 42, so as to align the beveled edge A1 of the flange 28*b* with the contact edge A2 of the sidewall 42 on each longitudinal end of the assembly.

Figure 21:
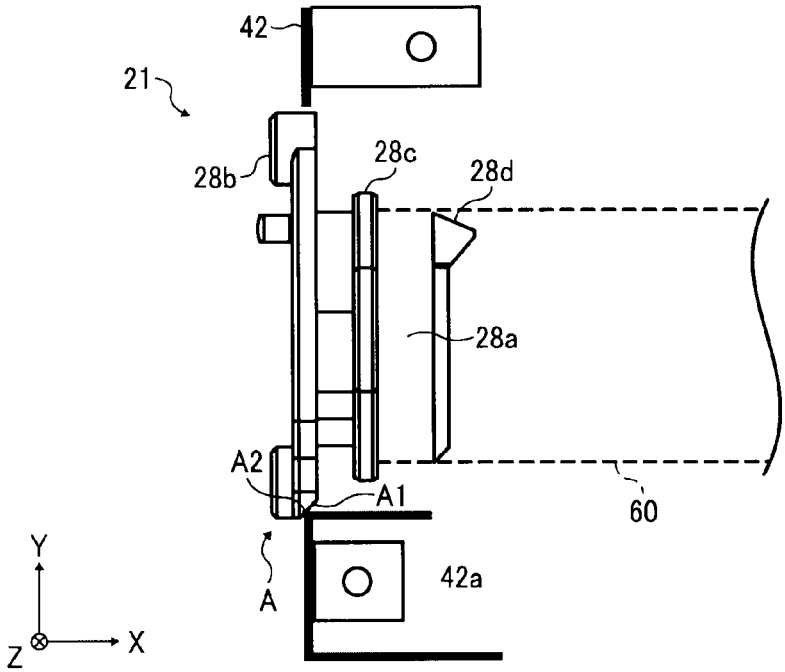
FIG. 21 is an end-elevational view taken in a load direction of the fuser belt assembly during mounting.

With additional reference to FIG. 21, which is an end-elevational view taken in the load direction Z of the fuser belt assembly during mounting, after initial positioning of the attachment 28, the operator then forces the attachment 28 against the contact edge A2 of the sidewall 42 in the conveyance direction Y, which causes the beveled edge A1 to slide against the contact edge A2 in an oblique direction to in turn move the attachment 28 in the axial direction X away from the longitudinal end of the belt holder 60. The attachment 28 stops sliding as the collar 28*c* of the attachment 28 reaches the adjoining surface of the sidewall 42. In this position, the flange 28*b* is substantially flush with the outer surface of the sidewall 42, resulting in an increased distance between the pair of attachments 28 on the opposed sidewalls 42, and a corresponding space or clearance created between the longitudinal end of the belt holder 60 and the collar 28*c* of the attachment 28 on each side of the fuser belt assembly.

Figure 22:
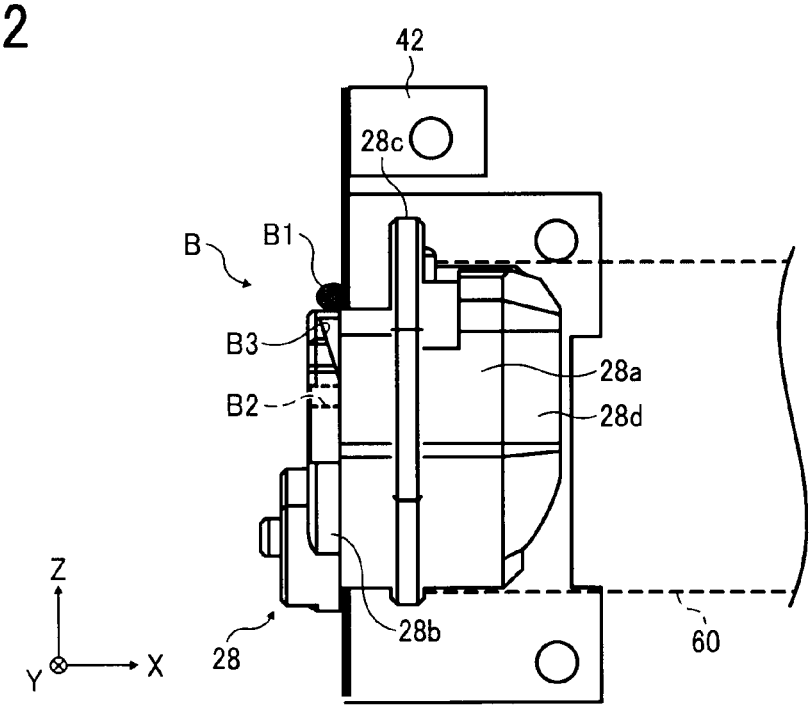
FIG. 22 is a top view taken in a conveyance direction of the fuser belt assembly during mounting.

With additional reference to FIG. 22, which is a top view taken in the conveyance direction Y of the fuser belt assembly during mounting, after the space between the holder end and the attachment collar is established, the operator then moves the attachment 28 toward the mounting bore 42*a* in the load direction Z while holding the flange 28*b* in contact with the outer surface of the sidewall 42, so that the peripheral edge of the flange 28*b* reaches the positioning protrusion B1. From this position, the attachment 28 can move on generally in the load direction Z while slightly displaced in the axial direction X, as the operator continues to force the assembly to cause the protrusion B1 to slide across the slope B3 toward the positioning hole B2.

Figure 23:
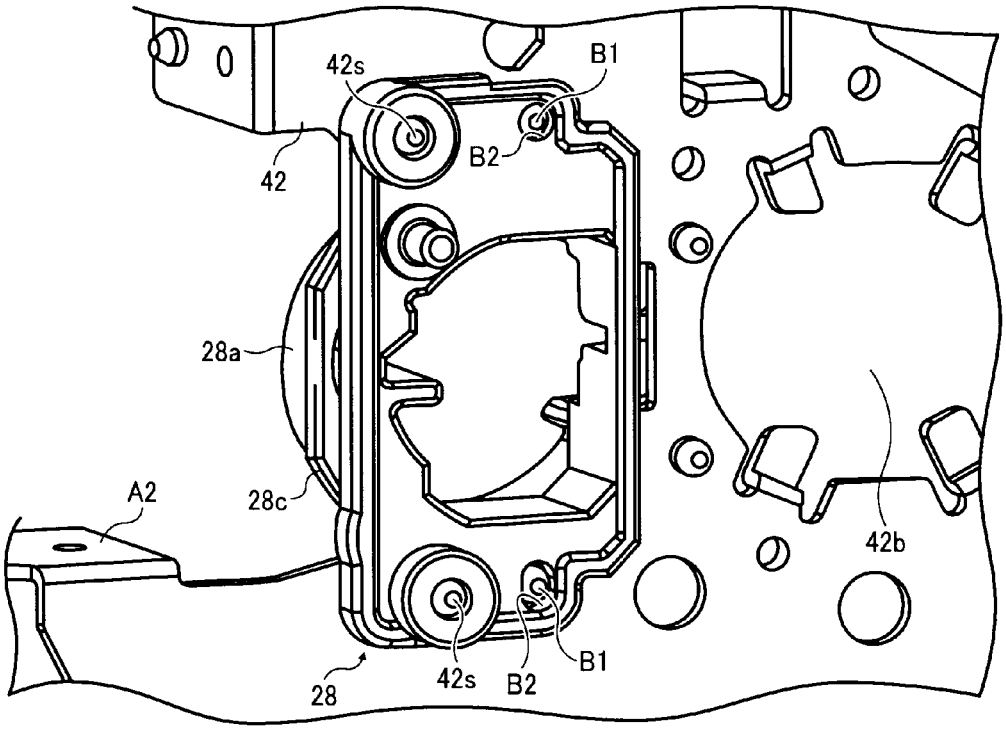
FIG. 23 is a perspective view of the mounting attachment fastened to the frame of FIG. 19.

As shown in FIG. 20B, movement of the attachment 28 in the load direction Z terminates where the protrusion B1 engages the hole B2, which establishes a proper operational position of the attachment 28 relative to the sidewall 42. Thereafter, the operator fastens the attachment 28 to the sidewall 42 by inserting screws 42*s* into the screw holes of the sidewall 42 and the attachment 28 aligned with each other, thereby completing mounting of the fuser belt assembly, as shown in FIG. 23.

Hence, the fixing device 20 according to this patent specification incorporates the fuser belt assembly which is ready to assemble and install in the image forming apparatus, owing to special configuration of the mounting attachment 28 for the tubular belt holder 60, wherein provision of the tubular insert 28*a* having a free axial end thereof at least partially protruding and tapered to form a tapered guide surface 28*d* allows for effortless insertion of the tubular insert 28*a* into the longitudinal end of the tubular belt holder 60 even with extremely small spacing between the circumferential surfaces of the attachment 28 and the holder 60.

Further, provision of the guiding mechanism A allows the operator to readily mount the fuser belt assembly with a desired space or clearance between opposed surfaces of the mounting attachment 28 and the belt holder 60 without the risk of excessively pulling out the tubular insert 28*a* from the belt holder 60, which would otherwise result in accidental disengagement and concomitant damage to the assembly. Moreover, provision of the positioning mechanism B with the slope B3, along which the positioning protrusion B1 is slidably guided into the positioning hole B2, eliminates the need for the operator to withdraw the tubular insert 28*a* from the belt holder 60 for introducing the protrusion B1 into the hole B2.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device, comprising:

a frame defining a space in which the fixing device is accommodated;

a belt holder that is tubular and extends in an axial direction;

a fuser belt that is rotatable and flexible, the fuser belt being looped into a generally cylindrical configuration around the belt holder to rotate in a circumferential direction of the belt holder;

a heater disposed adjacent to the belt holder to heat the belt holder to in turn heat the fuser belt through conduction;

a fuser pad accommodated in the belt holder inside a loop of the fuser belt, and extending in the axial direction of the belt holder;

a pressure member disposed opposite the belt holder with the fuser belt interposed between the fuser pad and the pressure member, the pressure member pressing in a load direction against the fuser pad through the fuser belt to form a fixing nip through which a recording medium travels in a conveyance direction under heat and pressure; and a mounting attachment on the frame and including a flange and a tubular insert extending from the flange, wherein the mounting attachment is detachably attached to the frame with the flange and provided to a longitudinal end of the belt holder to allow retention and detachable attachment of the longitudinal end of the belt holder to the frame, and wherein the tubular insert is inserted into the longitudinal end of the belt holder.

2. The fixing device according to claim 1, wherein the tubular insert has an opening that extends over a portion of a circumference around the tubular insert, and wherein a longitudinal end of the fuser pad is accommodated and retained in contact with the flange.

3. The fixing device according to claim 2, wherein the belt holder has an inwardly extending wall to define a side slot in one side of the belt holder, wherein the fuser pad is fit into the side slot, and wherein the opening of the tubular insert engages the inwardly extending wall of the belt holder together with the fuser pad.

4. The fixing device according to claim 1, further comprising a reinforcing member disposed inside the loop of the fuser belt to reinforce the fuser pad under pressure from the pressure member.

5. The fixing device according to claim 1, wherein the tubular insert includes a free axial end at least partially protruding and tapered to form a tapered guide surface, and wherein the tapered guide surface slidably guides an inner circumferential surface of the belt holder onto an outer circumferential surface of the tubular insert.

6. The fixing device according to claim 5, wherein the outer circumferential surface of the tubular insert is formed in a semi-cylindrical configuration along an upstream circumferential portion of the tubular insert adjoining the opening, wherein the outer circumferential surface retains the longitudinal end of the belt holder in the generally cylindrical configuration.

7. The fixing device according to claim 6, wherein the tapered guide surface extends from a downstream circumferential portion of the tubular insert different from the upstream circumferential portion along which the semi-cylindrical configuration of the outer circumferential surface extends.

8. The fixing device according to claim 6, wherein the tapered guide surface is positioned downstream from the fixing nip in the circumferential direction of the belt holder upon assembly of the fixing device.

9. The fixing device according to claim 1, further comprising a guiding mechanism provided between the mounting attachment and the frame for guiding the mounting attachment into position on the frame.

10. The fixing device according to claim 9, wherein the guiding mechanism allows positioning the mounting attachment relative to the belt holder to create a space between opposed surfaces of the mounting attachment and the belt holder in the axial direction.

11. The fixing device according to claim 9, wherein the guiding mechanism includes:

a beveled edge formed on the flange of the mounting attachment to define an inclined surface extending in an angled, oblique direction with respect to the axial direction; and a contact edge formed on the frame, wherein the beveled edge slides against the contact edge in the angled, oblique direction to in turn move the mounting attachment in the axial direction.

12. The fixing device according to claim 1, further comprising a positioning mechanism provided between the mounting attachment and the frame for positioning the mounting attachment relative to the frame as the flange slides against the frame generally in a direction perpendicular to the axial direction.

13. The fixing device according to claim 12, wherein the positioning mechanism includes:

a positioning protrusion extending in the axial direction from the frame;

a positioning hole defined in the flange of the mounting attachment to engage the positioning protrusion for establishing a proper operational position of the mounting attachment; and a slope adjacent to the positioning hole in the flange of the mounting attachment, wherein the positioning protrusion is slidably guided along the slope into the positioning hole as the flange slides against the frame generally in the direction perpendicular to the axial direction.

14. An image forming apparatus, comprising:

an electrophotographic imaging unit to form a toner image on a recording medium; and a fixing device to fix the toner image in place on the recording medium, the fixing device including:

a frame defining a space in which the fixing device is accommodated;

a belt holder that is tubular and extends in an axial direction;

a fuser belt that is rotatable and flexible, the fuser belt is looped into a generally cylindrical configuration around the belt holder to rotate in a circumferential direction of the belt holder;

a heater disposed adjacent to the belt holder to heat the belt holder to in turn heat the fuser belt through conduction;

a fuser pad accommodated in the belt holder inside a loop of the fuser belt, and extending in the axial direction of the belt holder;

a pressure member disposed opposite the belt holder with the fuser belt interposed between the fuser pad and the pressure member, the pressure member pressing in a load direction against the fuser pad through the fuser belt to form a fixing nip through which a recording medium travels in a conveyance direction under heat and pressure; and a mounting attachment on the frame and including a flange and a tubular insert extending from the flange, wherein the mounting attachment is detachably attached to the frame with the flange and provided to a longitudinal end of the belt holder to allow retention and detachable attachment of the longitudinal end of the belt holder to the frame, and wherein the tubular insert is inserted into the longitudinal end of the belt holder.

15. A belt assembly, comprising:

a frame defining a space in which the assembly is accommodated;

a belt holder that is tubular and extends in an axial direction;

a rotatable belt looped into a generally cylindrical configuration around the belt holder to rotate in a circumferential direction of the belt holder; and a mounting attachment on the frame and including a flange and a tubular insert extending from the flange, wherein the mounting attachment is detachably attached to the frame with the flange and provided to a longitudinal end of the belt holder to allow retention and detachable attachment of the longitudinal end of the belt holder to the frame, and wherein the tubular insert is inserted into the longitudinal end of the belt holder.

16. A fixing device, comprising:

a frame defining a space in which the fixing device is accommodated;

a belt holder that is tubular and extends in an axial direction;

a fuser belt that is rotatable and flexible, the fuser belt is looped into a generally cylindrical configuration around the belt holder to rotate in a circumferential direction of the belt holder;

a heater disposed adjacent to the belt holder to heat the belt holder to in turn heat the fuser belt through conduction;

a fuser pad accommodated in the belt holder inside a loop of the fuser belt, and extending in the axial direction of the belt holder;

a pressure member disposed opposite the belt holder with the fuser belt interposed between the fuser pad and the pressure member, the pressure member pressing in a load direction against the fuser pad through the fuser belt to form a fixing nip through which a recording medium travels in a conveyance direction under heat and pressure; and a mounting attachment provided to a longitudinal end of the tubular belt holder to allow retention and detachable attachment of the longitudinal end of the belt holder to the frame, the attachment including:

a flange adapted to be affixed to the frame, and a tubular insert extending from the flange to be inserted into the longitudinal end of the belt holder, the tubular insert having a free axial end at least partially protruding and tapered to form a tapered guide surface, an inner circumferential surface of the belt holder is slidably guided along the tapered guide surface onto an outer circumferential surface of the tubular insert that is inserted into the longitudinal end of the belt holder;

a guiding mechanism provided between the mounting attachment and the frame for guiding the mounting attachment into position on the frame, wherein the guiding mechanism allows positioning the mounting attachment relative to the belt holder to create a space between opposed surfaces of the mounting attachment and the belt holder in the axial direction.

17. A fixing device, comprising:

a frame defining a space in which the fixing device is accommodated;

a belt holder that is tubular and extends in an axial direction;

a fuser belt that is rotatable and flexible, the fuser belt is looped into a generally cylindrical configuration around the belt holder to rotate in a circumferential direction of the belt holder;

a heater disposed adjacent to the belt holder to heat the belt holder to in turn heat the fuser belt through conduction;

a fuser pad accommodated in the belt holder inside a loop of the fuser belt, and extending in the axial direction of the belt holder;

a pressure member disposed opposite the belt holder with the fuser belt interposed between the fuser pad and the pressure member, the pressure member pressing in a load direction against the fuser pad through the fuser belt to form a fixing nip through which a recording medium travels in a conveyance direction under heat and pressure; and a mounting attachment provided to a longitudinal end of the tubular belt holder to allow retention and detachable attachment of the longitudinal end of the belt holder to the frame, the attachment including:

a flange adapted to be affixed to the frame, and a tubular insert extending from the flange to be inserted into the longitudinal end of the belt holder, the tubular insert having a free axial end at least partially protruding and tapered to form a tapered guide surface, an inner circumferential surface of the belt holder is slidably guided along the tapered guide surface onto an outer circumferential surface of the tubular insert that is inserted into the longitudinal end of the belt holder;

a guiding mechanism including:

a beveled edge formed on the flange of the mounting attachment to define an inclined surface extending in an angled, oblique direction with respect to the axial direction, and a contact edge formed on the frame, wherein the guiding mechanism is provided between the mounting attachment and the frame for guiding the mounting attachment into position on the frame, and wherein the beveled edge slides against the contact edge in the angled, oblique direction to in turn move the mounting attachment in the axial direction.

18. A fixing device, comprising:

a frame defining a space in which the fixing device is accommodated;

a belt holder that is tubular and extends in an axial direction;

a fuser belt that is rotatable and flexible, the fuser belt is looped into a generally cylindrical configuration around the belt holder to rotate in a circumferential direction of the belt holder;

a heater disposed adjacent to the belt holder to heat the belt holder to in turn heat the fuser belt through conduction;

a fuser pad accommodated in the belt holder inside a loop of the fuser belt, and extending in the axial direction of the belt holder;

a pressure member disposed opposite the belt holder with the fuser belt interposed between the fuser pad and the pressure member, the pressure member pressing in a load direction against the fuser pad through the fuser belt to form a fixing nip through which a recording medium travels in a conveyance direction under heat and pressure; and a mounting attachment provided to a longitudinal end of the tubular belt holder to allow retention and detachable attachment of the longitudinal end of the belt holder to the frame, the attachment including:

a flange adapted to be affixed to the frame, and a tubular insert extending from the flange to be inserted into the longitudinal end of the belt holder, the tubular insert having a free axial end at least partially protruding and tapered to form a tapered guide surface, an inner circumferential surface of the belt holder is slidably guided along the tapered guide surface onto an outer circumferential surface of the tubular insert that is inserted into the longitudinal end of the belt holder;

a positioning mechanism provided between the mounting attachment and the frame including:

a positioning protrusion extending in the axial direction from the frame, a positioning hole defined in the flange of the mounting attachment to engage the positioning protrusion for establishing a proper operational position of the mounting attachment, and a slope adjacent to the positioning hole in the flange of the mounting attachment, wherein the positing mechanism positions the mounting attachment relative to the frame as the flange slides against the frame generally in a direction perpendicular to the axial direction, and wherein the positioning protrusion is slidably guided along the slope into the positioning hole as the flange slides against the frame generally in the direction perpendicular to the axial direction.

* * * * *